US005915429A

United States Patent [19]

Pelletier et al.

[11] Patent Number: 5,915,429

[45] Date of Patent: Jun. 29, 1999

[54] COMPACT SMALL DIAMETER LOG SAWMILL

[75] Inventors: Gilles Pelletier, D'Alembert; Jean Guy Bouchard, Macamic; Laurent Trudel, La Sarre; Serge Constantineau, Noranda, all of Canada

[73] Assignee: Tembec Inc., Montreal, Canada

[21] Appl. No.: 08/866,411

[22] Filed: May 30, 1997

[51] Int. Cl.[6] ..... B27M 1/00; B27C 1/08

[52] U.S. Cl. ..... 144/39; 144/3.1; 144/246.1; 144/250.2; 144/250.23; 144/220; 144/225; 144/235; 144/357; 144/370; 144/241; 144/178; 198/780; 198/782; 198/789

[58] Field of Search ..... 198/780, 782, 198/785, 788, 789; 144/3.1, 39, 41, 242.1, 246.2, 246.1, 250.2, 250.21, 250.23, 356, 357, 367, 369, 373, 378, 250.13, 218, 220, 225, 235, 236, 241, 162.1, 178

[56] References Cited

U.S. PATENT DOCUMENTS

| | | | |
|---|---|---|---|
| 3,457,978 | 7/1969 | Ahlstedt | 144/370 |
| 3,934,630 | 1/1976 | Cockle | 144/3.1 X |
| 3,960,041 | 6/1976 | Warren et al. | 144/370 |
| 4,015,648 | 4/1977 | Shephard | 144/370 |
| 4,327,789 | 5/1982 | Reuter | 144/39 |
| 4,335,767 | 6/1982 | Reuter | 144/3.1 X |
| 4,599,929 | 7/1986 | Dutina | 144/39 |
| 4,947,909 | 8/1990 | Stroud | 144/3.1 |
| 5,201,351 | 4/1993 | Hurdle | 144/369 |
| 5,396,938 | 3/1995 | Cannaday | 144/3.1 |
| 5,421,386 | 6/1995 | Lundstrom | 144/39 |

*Primary Examiner*—W. Donald Bray
*Attorney, Agent, or Firm*—Trevor C. Klotz

[57] ABSTRACT

A sawmill that is a compact integrated unit of a multiplicity of components all mounted on a common frame for performing different functions to produce pieces of lumber from a log. Logs can be processed that have a minimum diameter of approximately 2" and a minimum length of approximately 42" with the overall length of the mill being approximately 17'. There are a number of power driven feed and guide rolls that propel a log endwise along a fixed path. The processing components include first and second pairs of chipper canter units with novel chipper heads, a pair of rabbet units in which each has a pair of cutter heads on concentric telescopic shafts and power driven rolls for off-feeding pieces of lumber of differing widths. The log feed speed and/or chipper head speed can be varied to provide chips of selected different lengths. Positioning of the processing units is controlled by a programmed processor unit. The cut pattern and selective use of the edger is dictated by log geometry determined by scanning the logs before processing begins.

16 Claims, 16 Drawing Sheets

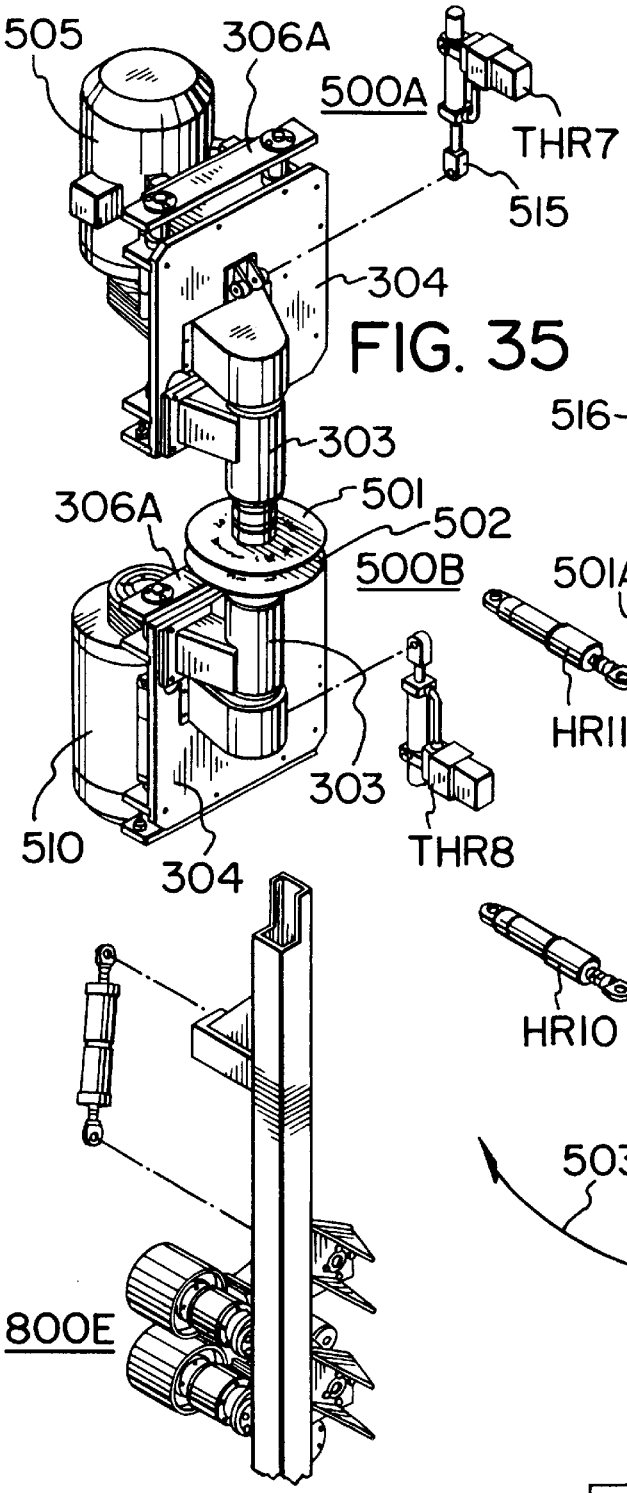
FIG. 35
FIG. 34
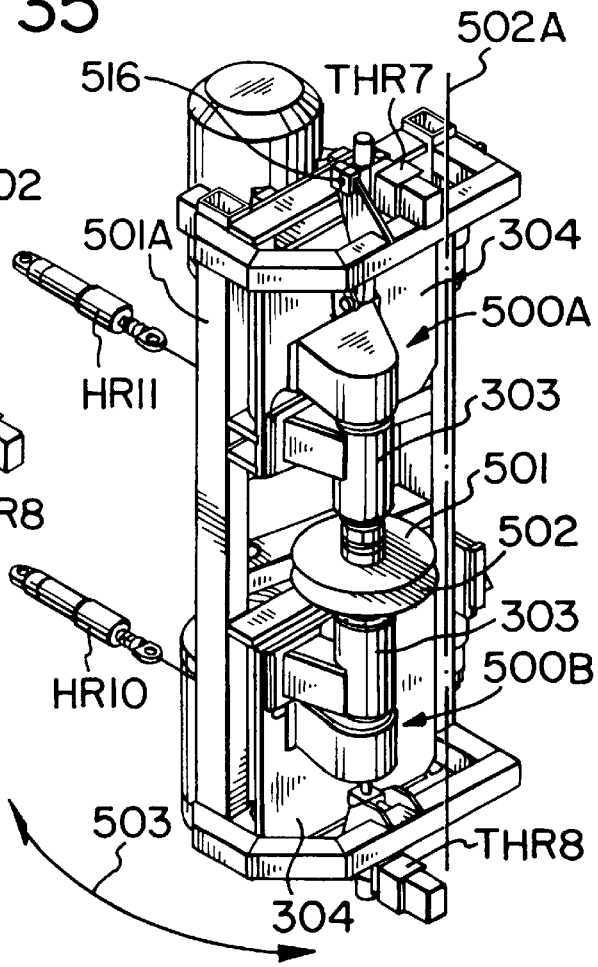
FIG. 36
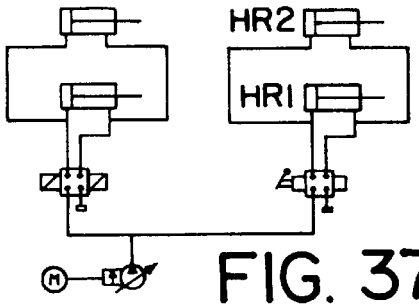
FIG. 37

COMPACT SMALL DIAMETER LOG SAWMILL

FIELD OF INVENTION

This invention relates generally to sawmills and more particularly to a compact integrated unit capable of producing lumber from logs of short length as well as logs that are relatively small in diameter.

The sawmill of the present invention has a multiplicity of components mounted on a common frame for performing different functions to produce lumber from a log. The sawmill is capable of producing a piece or pieces of lumber from a log having a minimum length of approximately 42 inches and a minimum diameter of approximately 2 inches.

The invention further relates to a novel mounting means for the components for the sawmill.

The invention further relates to a novel edger for rabbetting, as may be desired depending upon log geometry and desired sawing pattern, two longitudinal edges of a squared log.

The invention further relates to a novel lumber off feed mechanism.

The invention further relates to a novel log canter chipper head.

BACKGROUND OF INVENTION

Today's forests reserves include, in a number of areas, small diameter trees previously considered uneconomic for use in producing lumber. By small diameter is meant trees ranging from about 2 inches to about 8 inches in diameter. Also pieces of lumber have normally been produced from logs 16 feet in length. On small trees, however, it is not normally possible to get a 16 foot length suitable for conversion to lumber and thus it becomes necessary to produce pieces of lumber from logs of shorter length.

There is thus a need for equipment to be able to produce pieces of lumber from logs of relatively short length and also from logs that are relatively small in diameter. To be competitive it is also necessary to produce pieces of lumber from such logs in an economic manner and also produce quality chips.

It is known to produce chips when reducing a log from a squared piece of timber and by way of example reference may be had to U.S. Pat. No. 3,780,778 issued Dec. 25, 1973 to F. Chapman. This patent discloses a sawing and chipping machine.

In reducing a log to pieces of lumber it is well known to propel a log endwise through different pieces of machinery that perform different functions on the log as it is propelled. U.S. Pat. No. 5,143,127 issued Sep. 1, 1992 to K. Rautio discloses apparatus to propel and guide a log endwise along a predetermined path between a pair of spaced apart oppositely disposed chipper heads to produce chips and a pair of opposite parallel flat faces. Downstream from the chipper heads are circular saws with chipper edgers that produce pieces of lumber. Downstream from the saws are vertically disposed divider units that are aligned with the saw blades. In this apparatus the log is supported from below by a fixed in position slide rail and the cant chipper heads provide only two flat faces with such faces being in parallel vertical planes.

Squaring a log using a first pair of chipper heads and a second pair of chipper heads downstream from the first pair is known as for example from the teachings of Canadian patent issued Mar. 3, 1987 to K. Rautio. This patent also discloses sawing the squared timber into pieces of lumber by saws mounted on a frame that is pivotally supported the purpose of which is curve sawing.

Canadian patent 1,131,551 issued Sep. 14, 1983 to K. Rautio discloses first and second pairs of cutter heads and log propelling means mounted on a common frame for producing a squared timber piece from a log. The patentee mentions that circular saw blades may be provided for cutting the squared timber piece into "one or several parts".

There is no mention or suggestion in the foregoing prior art of squaring the log to a first selected dimension and rabbetting the corners to maximize the lumber obtained from a given tree size or given range of tree sizes.

Canter chippers are known and by way of example reference may be had to PCT/SE92/00063 published Aug. 20, 1992 under international publication number WO92/13685. Disclosed in this PCT application is a chipper head in the form of a truncated cone with replaceable cutters mounted thereon.

SUMMARY OF INVENTION

A principle object of the present invention is to provide a compact sawmill capable of converting small diameter logs to lumber.

A further principle object of the present invention is to provide a sawmill with a plurality of processing components mounted on a frame and located in closely spaced apart relation downstream from one another permitting converting short logs to pieces of lumber.

A still further object of the present invention is to provide a novel cutting head for a chipper canter.

A still further object of the present invention is to provide a compact sawmill with processing components selectively adjustably mounted on a common frame and particularly positioned relative to a path of travel of a log propelled endwise during processing.

A still further object of the present invention is to provide a novel edger for rabbetting at the same time two edges of a piece of timber.

A further object of the present invention is to provide a sawmill with a plurality of components movably mounted on a rigid frame and means for selectively controlling movement of the components to square a log and divide the square timber into pieces of lumber using various different cutting patterns dependent upon the geometry of the log to maximize the amount of lumber obtainable from the log of particular size or logs having a range of sizes.

LIST OF DRAWINGS

The invention is illustrated by way of example in the accompanying drawings wherein:

FIGS. 26 to 33 are views of cutter heads for the edgers illustrated in FIG. 24 and in which FIGS. 27 to 29 illustrate one embodiment of cutter head and FIGS. 30 to 33 illustrate a second embodiment;

FIG. 26 is an oblique view of the outer cutter head of the upper edger unit shown in FIG. 24;

FIG. 27 is an oblique for the outer cutter head of the lower edger unit shown in FIG. 24;

FIG. 28 is an oblique view showing the rear face of the cutter head in FIG. 26;

FIG. 29 is an oblique view illustrating the hub portion of the inner cutter head for the upper unit shown in FIG. 24;

FIGS. 30 and 31 are oblique views, taken from the rear face, of alternative outer cutter heads for the respective upper and lower edger units shown in FIG. 24;

FIG. 32 is an oblique view from the front face of an inner cutter head for an upper edger unit;

FIG. 33 is an exploded view of the cutter head shown in FIG. 31;

FIG. 34 is an oblique view illustrating the small diameter timber propelling powered rollers;

FIG. 35 is an oblique view of a pair of driven saws for severing a squared timber into pieces of lumber;

FIG. 36 is an oblique view of the pair of saws of FIG. 35 mounted on a support frame that pivotally attaches to the frame portion A shown in FIG. 3;

FIG. 37 is a hydraulic schematic for controllable movement of the secondary frame;

DESCRIPTION OF PREFERRED EMBODIMENT

Figure 1:
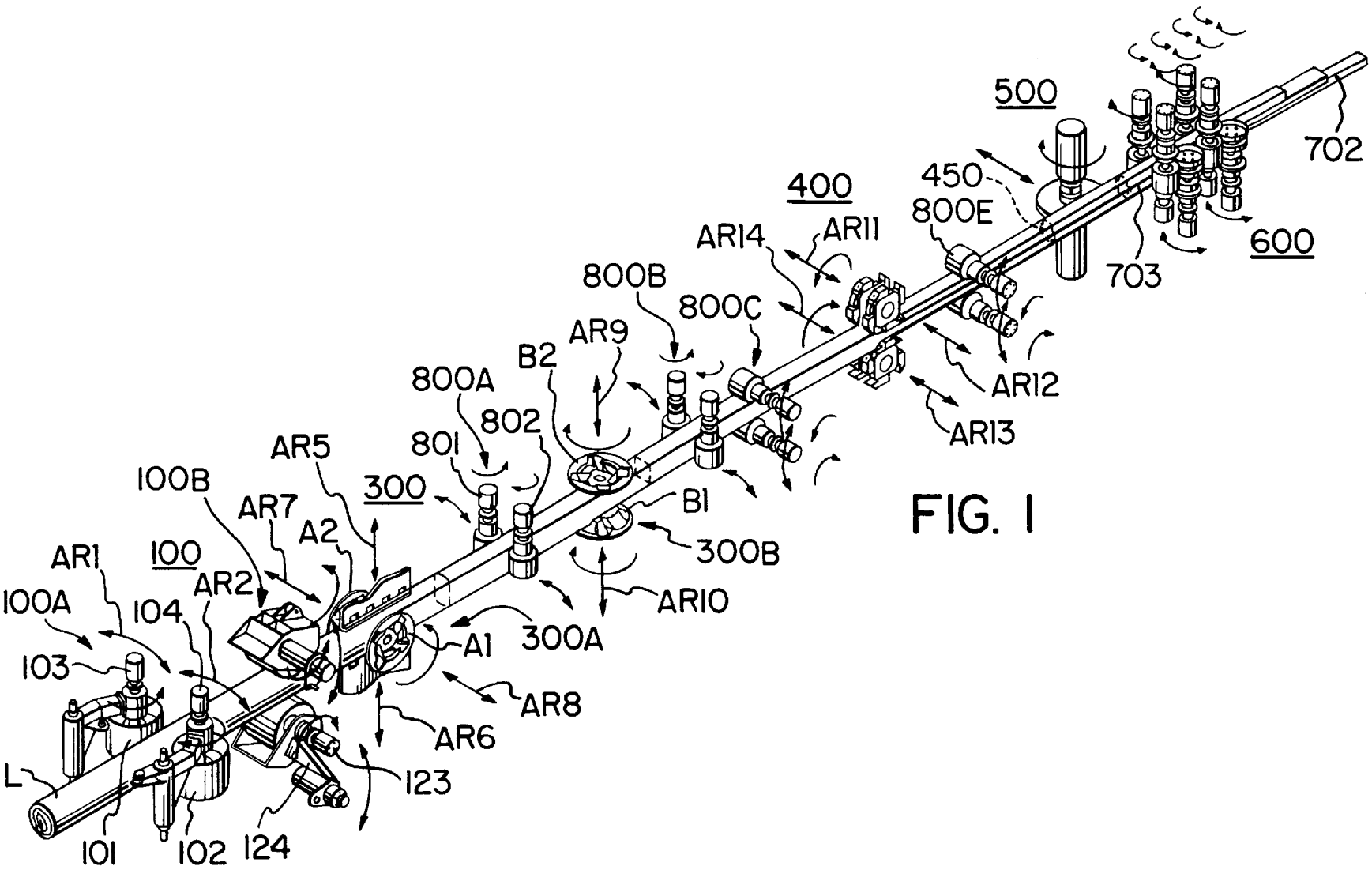
FIG. 1 is an oblique, diagrammatic, view illustrating the operative processing system and components of a sawmill of the present invention which is capable of converting small diameter logs into pieces of lumber as well as short lengths of logs into pieces of lumber.
Figure 1A:
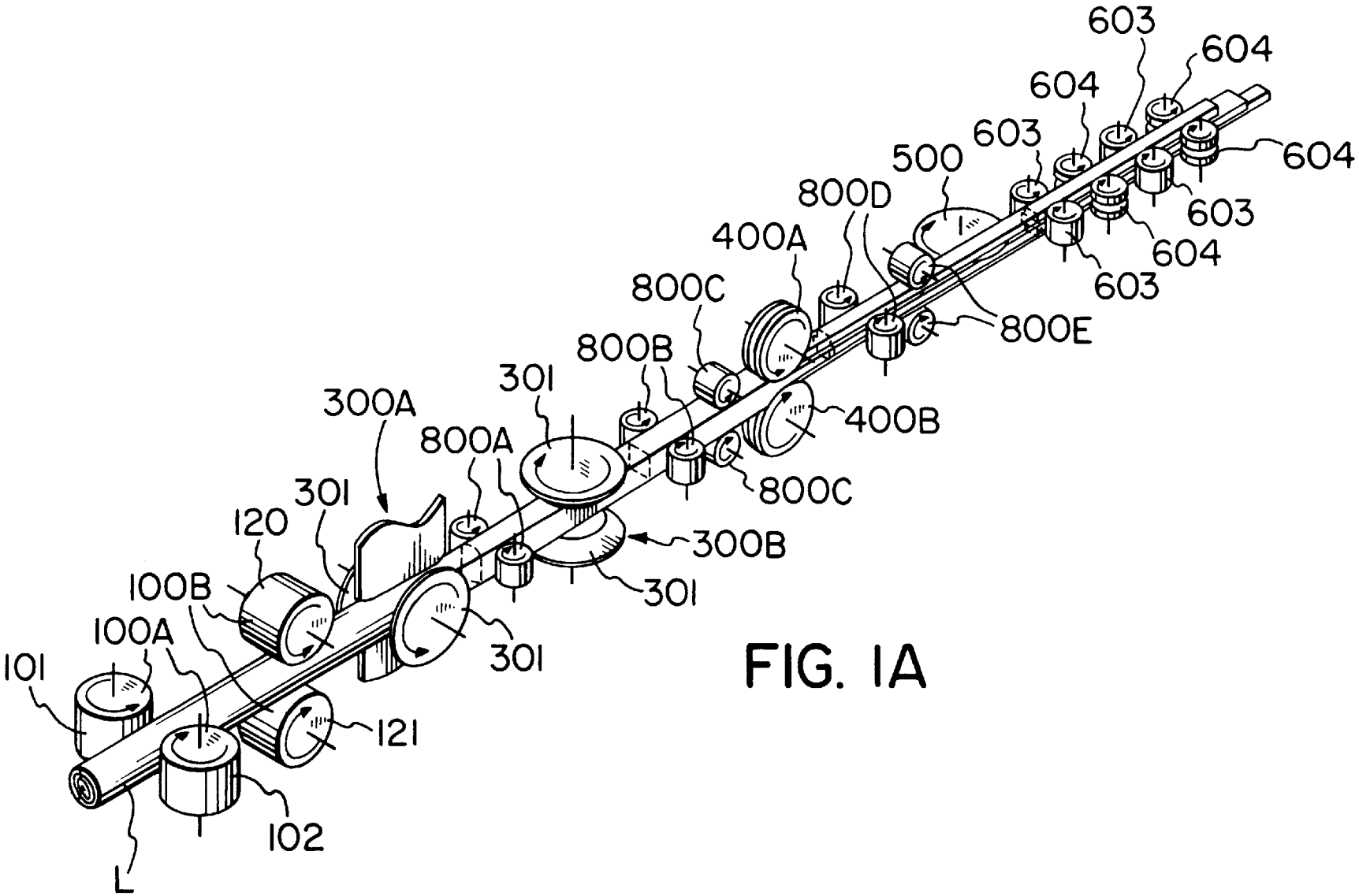
FIG. 1A is a schematic, more general than FIG. 1, illustrating the spacing of the components to provide a compact sawmill.
Figure 2:
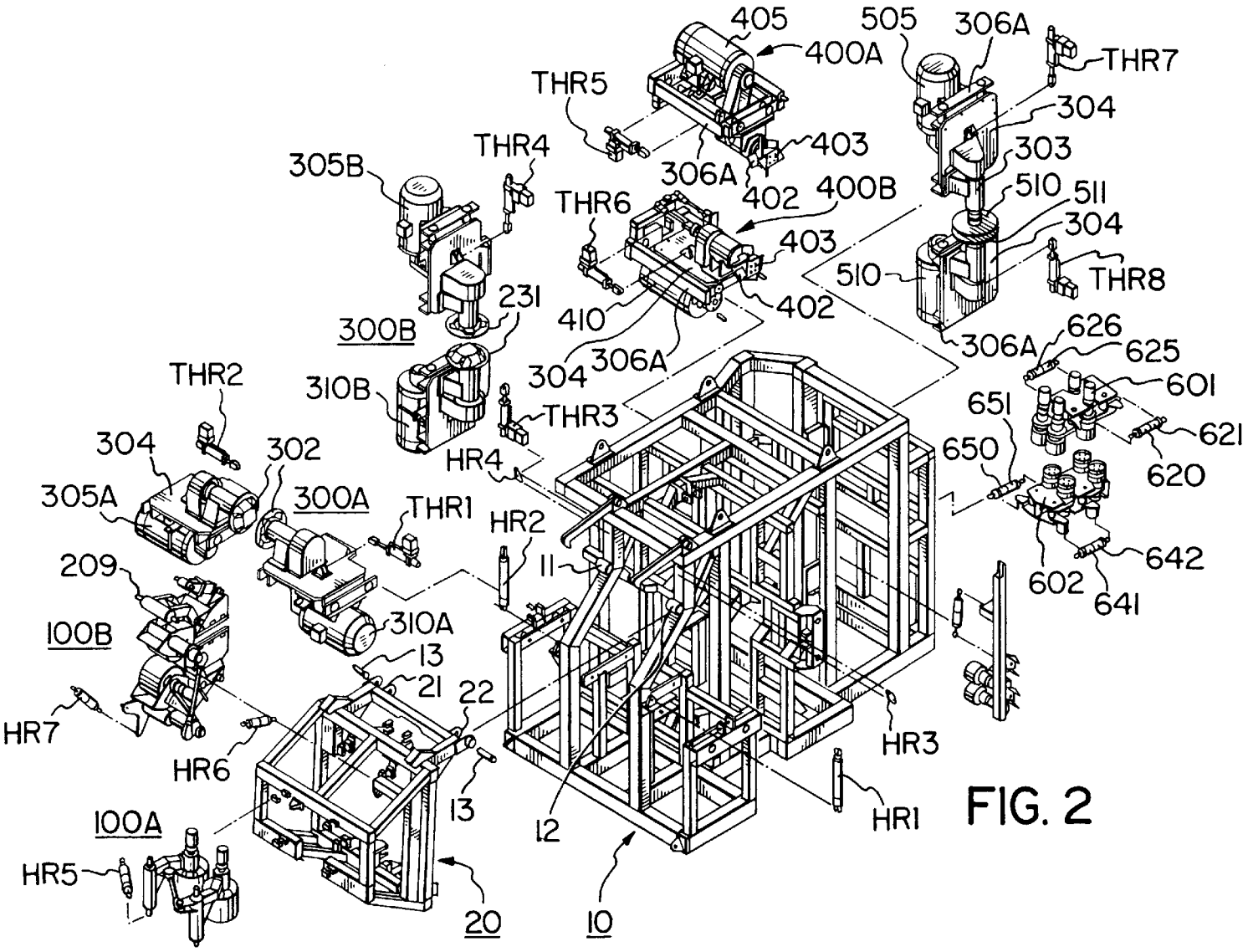
FIG. 2 is an exploded view showing the same components as in FIG. 1 and a frame associated therewith on which the components are mounted to provide a compact sawmill.
Figure 3:
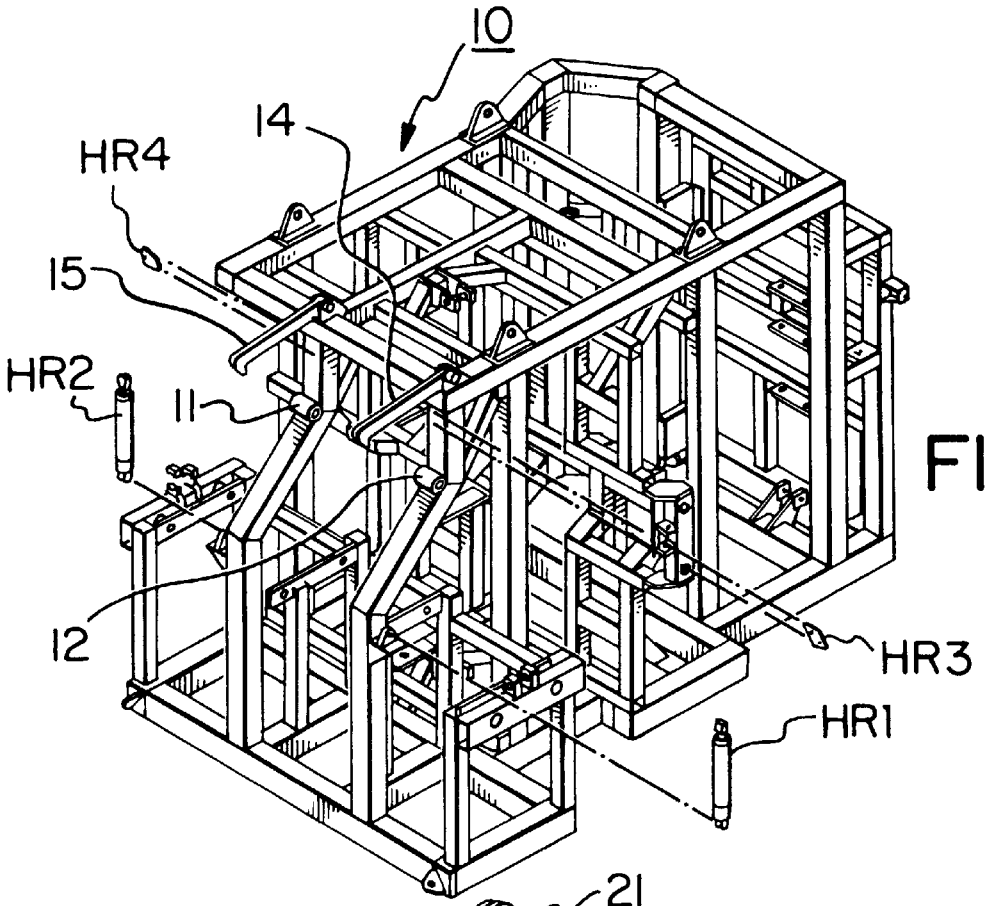
FIG. 3 is an oblique view of the stationary portion of the frame shown in FIG. 2 for some of the components of the sawmill and the hydraulic cylinder units for moving such components and pneumatic cylinders for releasably locking the movable frame in a raised position.
Figure 4:
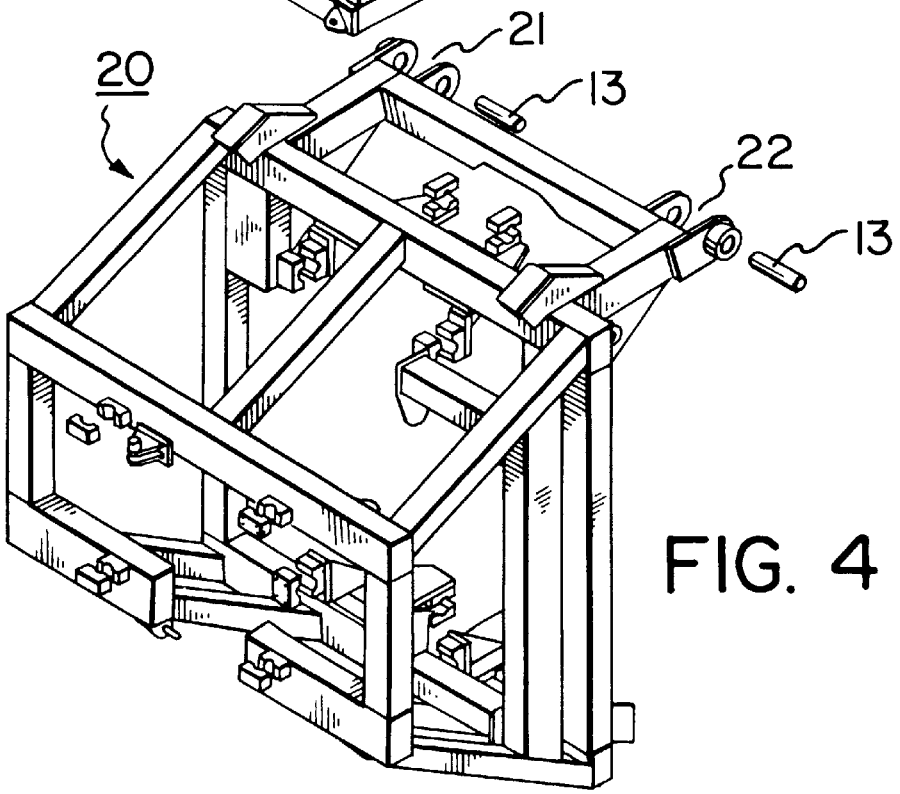
FIG. 4 is an oblique view of a secondary portion of the frame on which some of the components are mounted and wherein such portion of the frame is pivotally attached to the stationary frame portion permitting easier access for service and maintenance of components mounted on the stationary frame thereon.

The compact sawmill of the present invention comprises the following processing and handling components:

(a) an infeed section 100 in which there is a first and a second pair of large diameter power driven feed rolls for propelling a log endwise along a preselected feed path and a log guide 200;

(b) a canting section 300 in which there is a first and a second pair of chipper canter units offset 90° from one another about the axis of the feed path;

(c) an edging section 400 in which there is an upper edger unit and a lower edger unit for rabbetting the four corners of the squared timber;

(d) a timber sub-dividing or sawing section 500;

(e) a plurality of small diameter power driven feed rolls variously located between the processing units for engaging the flat faces of the squared timber piece to guide and propel it along the preselected feed path; and (f) a lumber outfeed conveyor section 600.

The operational components for these various sections to perform the various processing functions, described in more detail hereinafter, are mounted on a structure of members providing a framework which is a rigid support for all of the units. The components are closely spaced and thus provided is a compact integrated self sustaining sawmill unit.

The framework (a weldment and/or bolted together members) includes a stationary primary frame portion 10 and a secondary frame portion 20. The frame portion 20 is movably mounted on the frame portion 10 such movement being provided by a pivotal interconnection of frame portions 10 and 20. The pivotally mounted frame portion 20 allows for easier access to components downstream from the infeed section for service and maintenance purposes which otherwise without the pivotal movement of the frame portion would be difficult to access. Access to the components is quite restricted because of the compactness of the sawmill and while it is not essential to the system that frame portion 20 be pivotally connected to frame portion 10 it certainly is desirable.

The frame portion 20 has two pairs of apertured lugs designated respectively 21 and 22 that receive respective sleeves 11 and 12 secured to rigid frame portion 10. A pair of pins designated 13 pivotally interconnects the frame portions and a pair of hydraulic cylinders HR1 and HR2 are secured at one end by pins (not shown) to frame portion 10 and at the other end to frame portion 20. By actuating these hydraulic cylinder units frame portion 20 can be pivotally moved to a raised position and locked in that position by a pair of hooked members designated 14 and 15 controlled by respective pneumatic cylinders HR3 and HR4. Raising of the frame portion 20 (which has the infeed pairs of rollers thereon) provides access to a first pair of chipper canter units immediately downstream from the infeed rolls for maintenance and repair purposes.

The infeed section 100 is mounted, as mentioned, on secondary frame portion 20 and includes first and second feed roll units 100A and 100B, each of which has a pair of power driven rolls for tractively engaging and propelling a log endwise for processing by the components of the sawmill. The feed rolls are moved toward and away from a predetermined fixed in position feed path axis. As viewed in FIG. 1 a log L is propelled endwise in a direction from left to right during the processing functions which are performed at positions spaced from one another longitudinally along the log.

By way of example and to give an indication of the compactness an actual constructed experimental prototype machine has an overall length of approximately 17 feet. The center-to-center spacing between adjacent components used in the processing is less than the shortest length of log to be processed. For example the spacing of components may be in the range of 24 to 36 inches (center-to-center) in a sawmill capable of processing logs approximately 42 inches in length. The spacings, however, can obviously vary depending upon the size of components and/or length of logs to be processed. In the experimental prototype lumber pieces were successfully produced from logs as short as 30" in length and as small as 2" in diameter.

Figure 5:
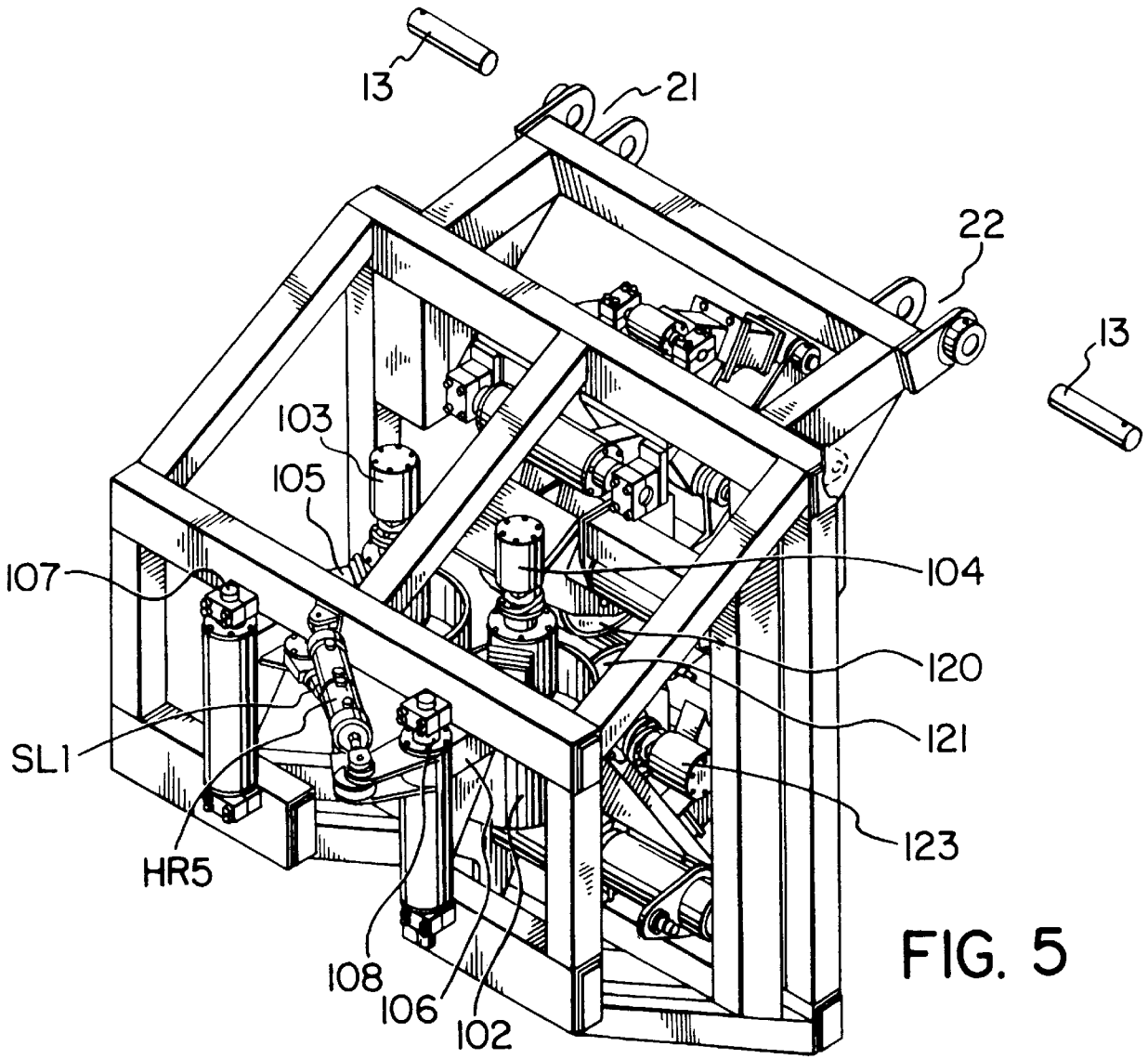
FIG. 5 is an oblique view of the secondary frame portion of FIG. 4 with some of the components mounted thereon.
Figure 6:
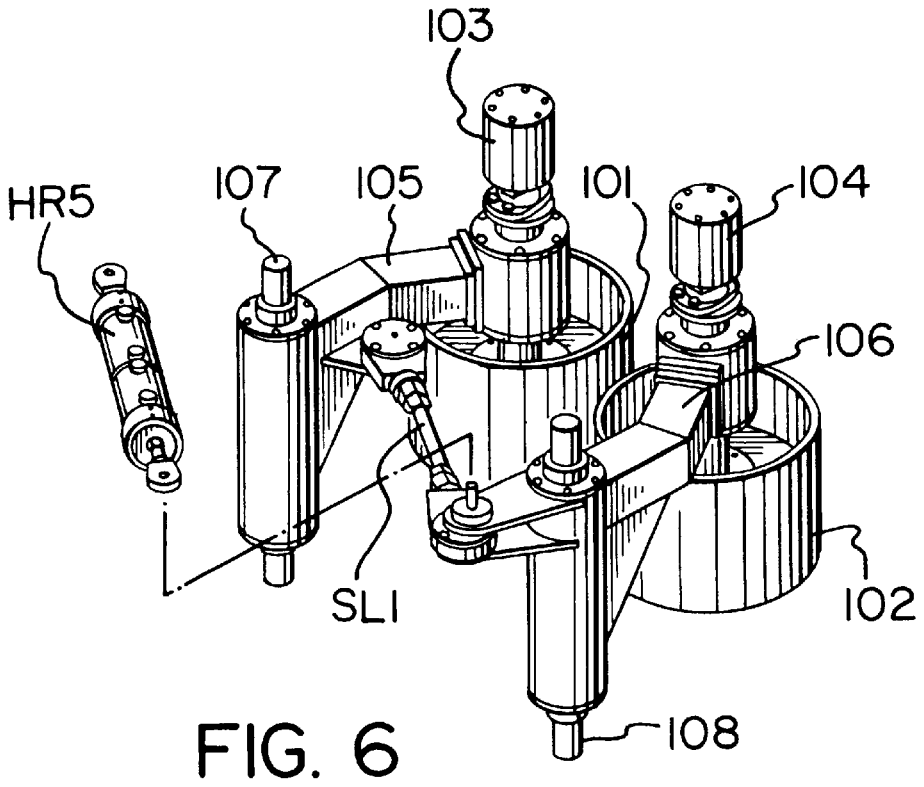
FIG. 6 is an oblique view of a first set of infeed rolls for propelling a log endwise along a preselected feed path in which such log is processed by the different components as it passes through the sawmill.

The first feed roll unit 100A (see FIG. 6) comprises feed rolls 101 and 102 driven by respective hydraulic motors 103 and 104. Feed rolls 101 and 102 are mounted on respective arms 105 and 106 which are pivotally mounted on the secondary frame 20 by respective shafts 107 and 108. The feed rolls are moved towards and away from one another (see FIGS. 5 and 6) by a pneumatic cylinder unit HR5 and a synchronizing link SL1 the latter of which interconnects the arms 105 and 106. The feed rolls have a suitable surface to tractively engage the log L such surface of the feed rolls being generally cylindrical. The feed rolls move in arcs designated AR1 and AR2 in FIG. 1 and these arcs are in a horizontal plane. The feed rolls as mentioned are cylindrical and rotate about respective vertical axes with the arms 105 and 106 interconnected by the link SL1 to synchronize their movement toward and away from the log disposed therebetween.

The second set of feed rolls 100B similarly comprises a pair of cylindrical feed rolls designated 120 and 121 driven by respective hydraulic motors 122 and 123. Feed rolls 120 and 121 and their respective drive motors are mounted on respective arms 124 and 125 which are pivotally attached to the secondary frame B by respective ones of a pair of shafts not shown. The shafts 124 and 125 are interconnected by a synchronizing link SL2. The feed rolls 120 and 121 move in arcs designated AR3 and AR4 which are disposed in a vertical plane. The first and second set of feed rolls 100A and 100B accordingly are located offset from one another 90° around the axis of the path along which a log travels while being processed. The log is gripped and held tightly between the feed rolls with such feed rolls engaging the top and bottom and two opposite side surfaces of the log. The feed rolls of the first and second sets 100A and 100B are controllably moved toward and away from a fixed in position feed path axis by the respective pneumatic cylinder unit HR5 and hydraulic cylinder unit HR2, movement of the feed rolls in the respective sets being synchronized by the links SL1 and SL2.

The log guide unit 200 is mounted on the movable frame portion 20 closely adjacent and downstream from the second feed roll unit 100B. The log guide unit comprises respective upper and lower guide shoes 201 and 202 disposed in close proximity to the outfeed side of second feed roll unit 100B. The guide shoes are movably mounted on the frame 20 by links in a parallelogram arrangement for reciprocal movement up and down in a vertical plane as indicated by respective double headed arrows AR5 and AR6 (see FIG. 1).

Figure 7:
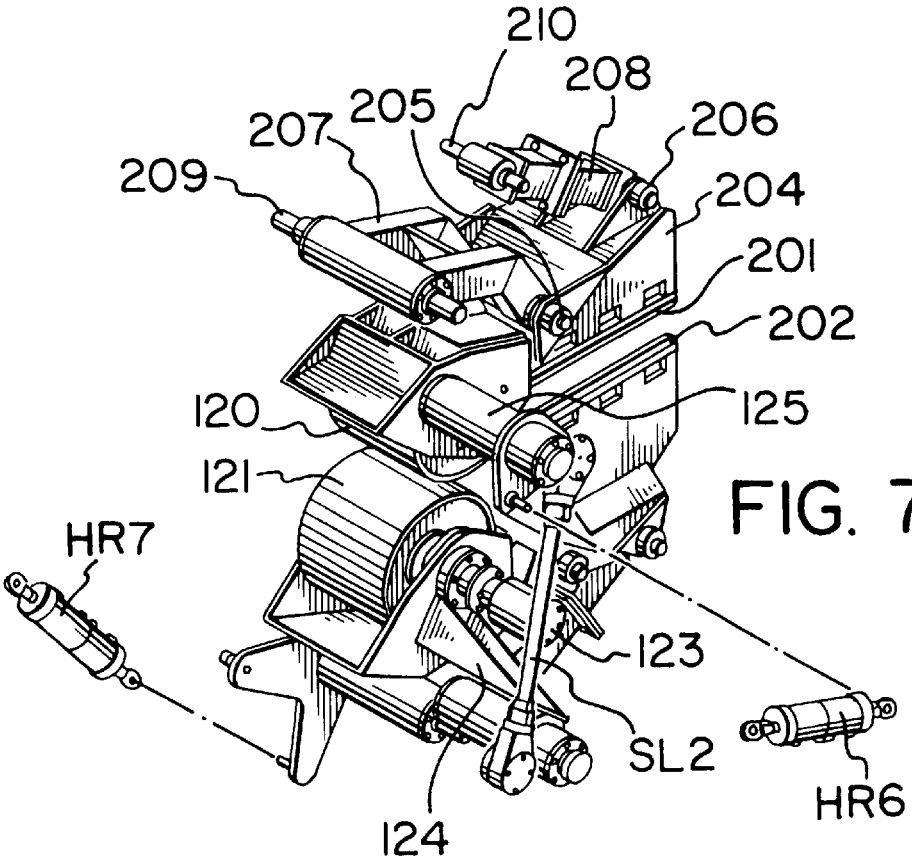
FIG. 7 is an oblique view of a second set of infeed rolls downstream from the first set and a log guide.

Referring to FIG. 7 guide shoe 201 is mounted on a blade 204 pivotally connected as at 205 and 206 respectively to arm 207 and link member 208. Members 207 and 208 pivotally connect to the frame 20 by respective pivot pins 209 and 210. The pins 205, 206, 209 and 210 provide a parallelogram linkage connection of the shoe 201 to the frame. Guide shoe 202 is similarly mounted and the shoes are controllably moved toward and away from one another by pneumatic cylinder HR7.

The canting section 300 has a first canting section 300A and downstream therefrom a second canting section 300B. The first canting section produces a pair of parallel vertically disposed flat faces on the log as the log is propelled endwise by the power driven rollers and the second canting section 300B produces a pair of horizontally disposed flat faces. The squared piece of timber is represented in FIG. 1 by the broken line designated SQ1. The timber piece, if desired, could be rectangular in cross-section instead of square.

The two canting sections are the same except for their orientation relative to the log about the longitudinal axis of the feed path. The first canting section 300A is shown in more detail in FIG. 8 and the second canting section in FIG. 9. Since both sections have the same components and for purposes of simplification the same reference numerals are used herein in designating the components of the two canter sections 300A and 300B.

Each canter section comprises a pair of chipper canter units 301 which are located respectively on opposite sides of the log being processed. Each chipper canter unit 301 has a chipper head 302. The pair of chipper heads located on opposite sides of the log rotate in the same direction and thus one chipper head of the pair is a mirror image of the other. The construction of each unit 301 is otherwise the same and again for simplification of description only one chipper canter unit is described in detail herein.

Figure 8:
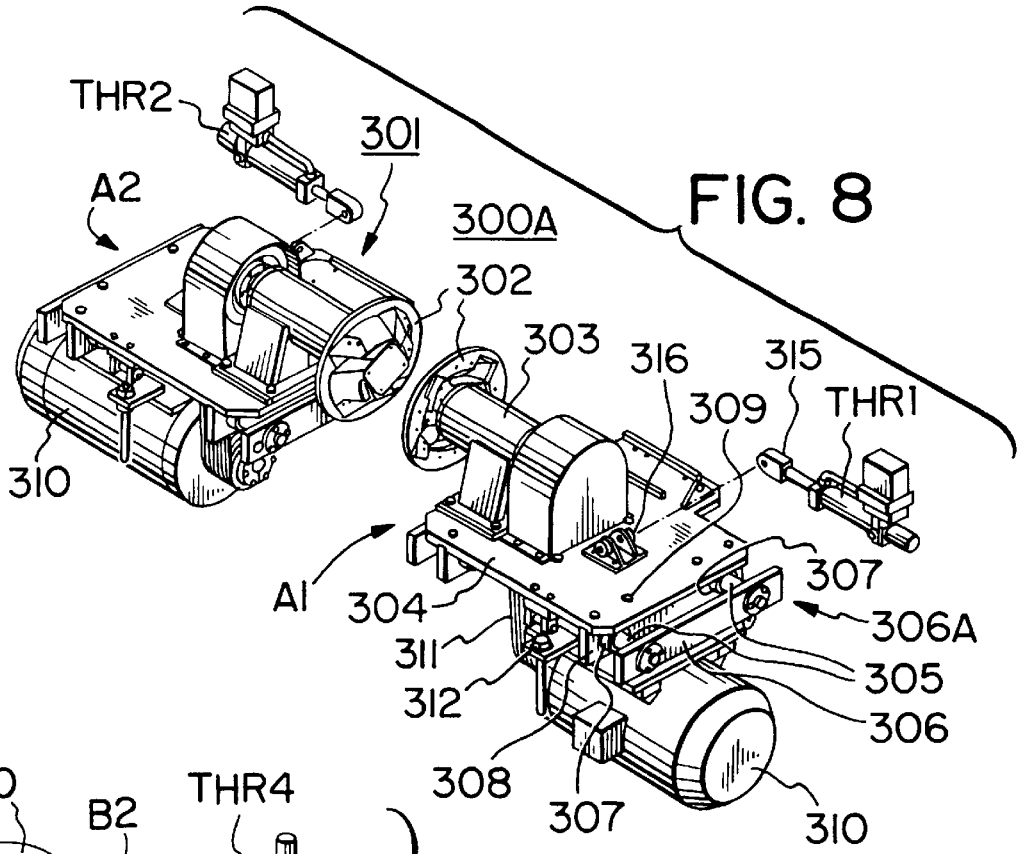
FIG. 8 is an oblique view of a first pair of milling head type canter units for producing a first vertical pair of parallel flat faces on the log.
Figure 9:
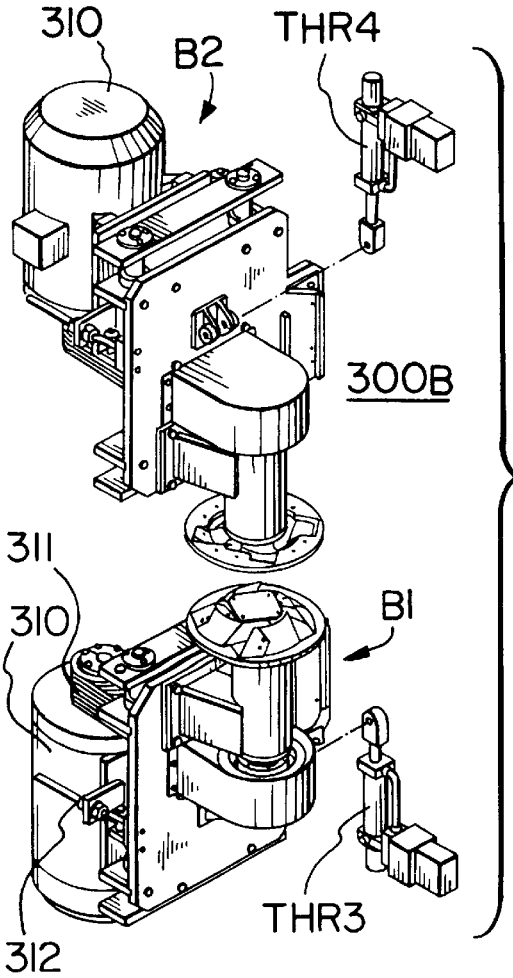
FIG. 9 is an oblique view of a second pair of milling head type canter units, offset 90° from the first set, for producing two horizontal parallel faces whereby the log is reduced to a squared timber piece.

The location of the four chipper canter units in FIGS. 1, 8 and 9 are designated A1 and A2 for the canter section 300A and B1 and B2 for the canter section 300B. The position designations A1, A2, B1 and B2 in FIGS. 8 and 9 of the drawings are encircled.

Referring to FIGS. 8 and 9 each chipper canter unit has a chipper head 302 removably secured to a shaft that is journalled for rotation in a housing 303. The housing is rigidly secured to a base plate 304 which is slidably mounted on a pair of parallel spaced apart rigid shaft 305. The shafts 305 are interconnected at opposite ends by respective ones of a pair of end bars 306. The shafts and the bars (305 and 306) provide a rigid structure 306A that is mounted on the frame 10 and provides a mounting base on which the base plate 304 slides. The positioning is such that the chipper heads are slidably movable along shafts 305 so as to move in a direction toward and away from the feed path whose axis is fixed in position and designated x—x in FIGS. 20 to 23.

Figure 21:
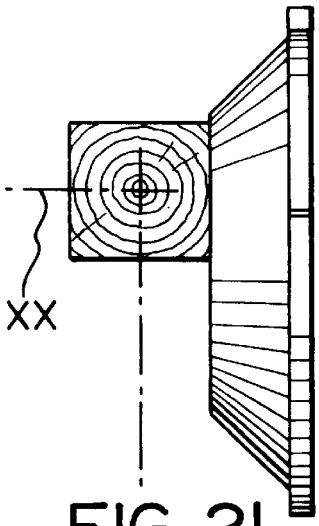
Figure 22:
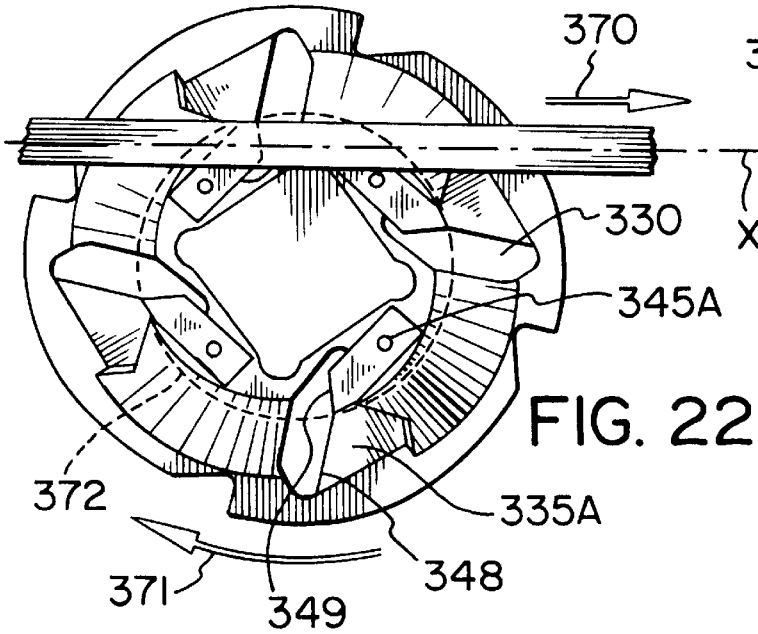
FIGS. 22 and 23 are similar to FIGS. 20 and 21 and illustrate the relative positioning for a smaller piece of timber permitted by an embodiment in which the canter units are selectively adjustably positionable.
Figure 23:
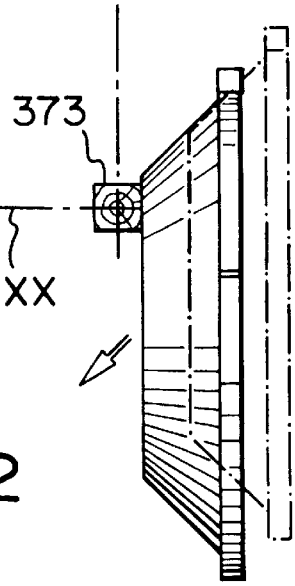
Figure 24:
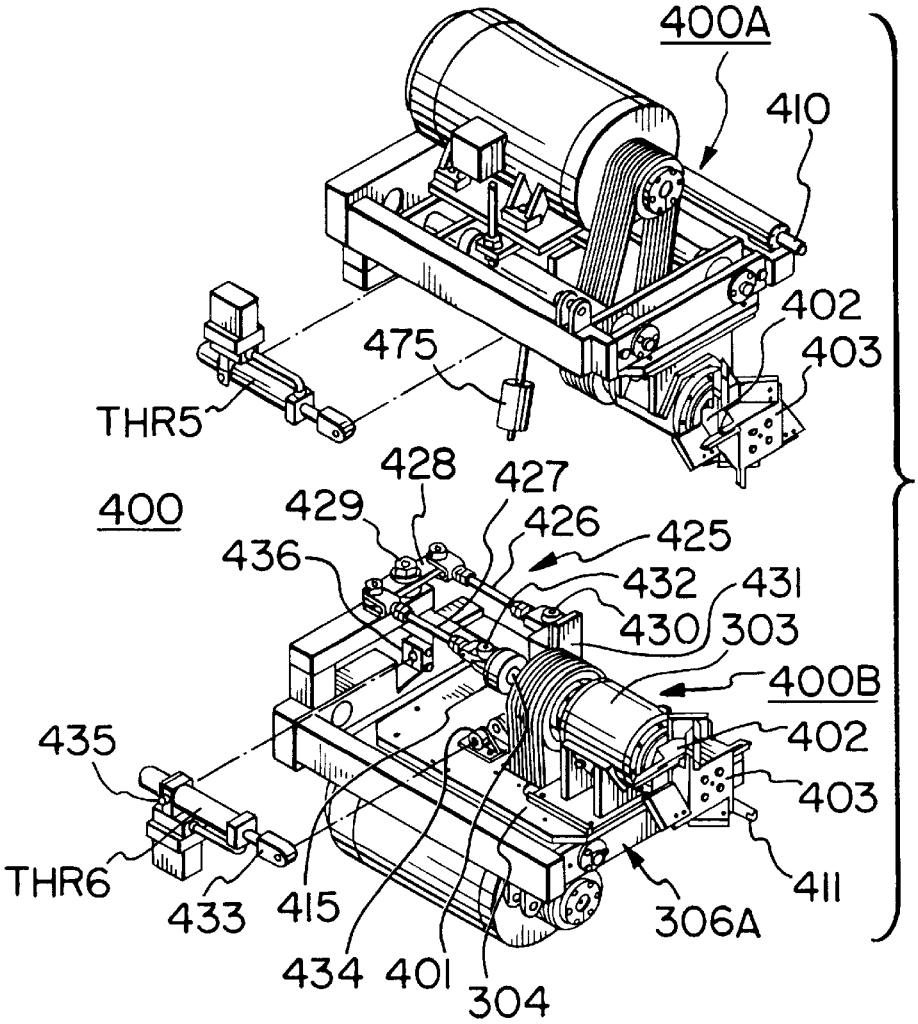
FIG. 24 is an oblique view of a pair of edger units for selectively rabbetting the four corners of the squared log.

The rigid structure 306A may be fixedly mounted on frame 10 or alternatively movably mounted so as to be selectively movable for adjusting the chipper head position relative to a timber piece to provide the relative positioning illustrated in FIGS. 21 and 23. With reference to FIGS. 20 to 23 the flat face on the chipper head is shown positioned so that the peripheral cutting edge thereof maintains a preselected position relative to the edge of the timber piece. This relative positioning for differently dimensioned square timber pieces can be provided for by pivotally mounting structures 306A on the frame 10 and providing for example a turn buckle type adjusting mechanism to adjustably change the position of chipper unit. Hydraulic cylinder units e.g. Temposonic* units may be used in place of turn buckles for precise adjustment. Referring to FIG. 24 the frame 306A can be provided with a pivot mounting shaft 411 for one of the two chipper units in FIG. 8 and FIG. 9 and the other chipper units in the respective pairs with a pivot mounting shaft 410. Shafts 410 and 411 pivotally attach to frame 10 and adjusting mechanisms such as unit 475 interconnects the frame 306A associated therewith and frame 10.

*Trade-Mark

As previously mentioned the base plate 304 slides on shafts 305 and to accomplish this there are collars 307 (two of them) on each of two bars 308. The two such bars 308, with the collars thereon, are secured to the base plate 304 at spaced apart positions thereon by threaded studs 309.

The cutter head 302 is driven by an electric (or hydraulic if desired) motor 310 which is mounted on the base plate 304 and by way of a plurality of V-belts 311 (or direct drive if desired) drives the shaft on which the cutter head is mounted. Tensioning of the V-belts can be adjusted by means of a belt tensioner 312 that adjustably moves the motor 310 relative to the base plate 304.

The positioning of the four cutter heads designated A1, A2, B1 and B2 are selectively adjustable by respective hydraulic piston cylinder units THR1, THR2, THR3 and THR4. Movement of the cutter heads is in a direction toward and away from a log disposed therebetween and this movement is represented in FIG. 1 by double headed arrows AR7, AR8, AR9 and AR10. Referring to FIG. 8 the piston end 315 of the hydraulic unit THR1 by way of a pin (not shown) is connected to lugs 316 on the plate 304 and the cylinder portion is anchored to the frame 10. These hydraulic cylinders are accurately controllable and the ones preferred are known under the trade name Temposonic*. Temposonic hydraulic cylinders have a feedback loop and positioning accuracy is about ±1/1000 of an inch.

*Trade-Mark

The cutter head 302 is of novel construction made by the present applicants and has proven most effective from trial tests conducted with their prototype sawmill. Details of the cutter head are shown in FIGS. 10 to 17 inclusive and there are two embodiments illustrated. These are the preferred embodiments arrived at after extensive experimentation, modification and testing. FIGS. 10 to 13 represent one embodiment and FIGS. 14 to 19 represent a second embodiment which differs from the first mainly with respect to the symmetrical shape of the cutters so as to be reversible for left and right mountings and in details of the mounting of the main cutter blades.

Figure 10:
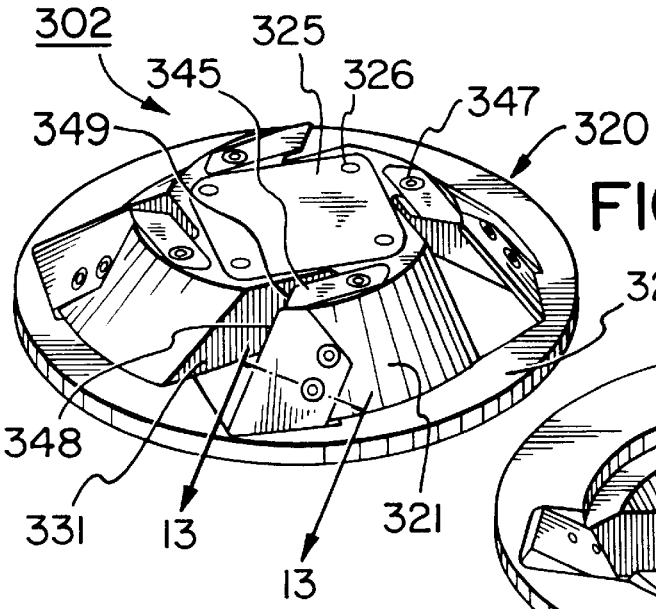
FIG. 10 is an oblique view showing the front face of one canter cutter head.
Figure 11:
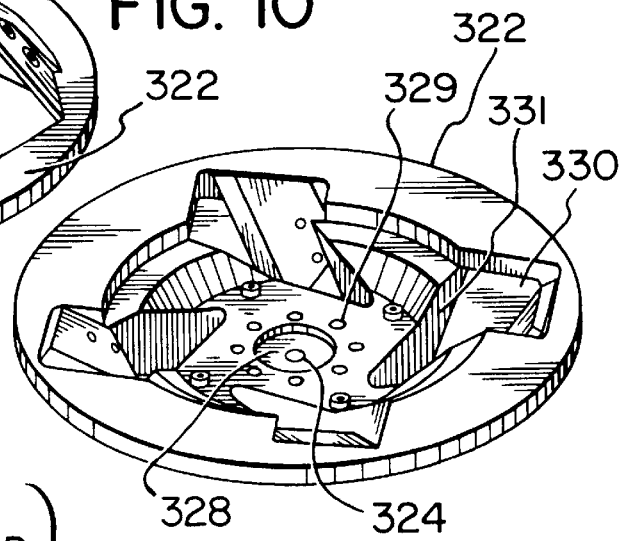
FIG. 11 is an oblique view showing the rear face of the cutter head of FIG. 10.

Referring to FIG. 10 the chipper head 302 comprises a rigid base member 320 which has a truncated conical portion 321 projecting outwardly from an annular rigidifying rim portion 322. The outer end of the truncated portion 321 has a rectangular recess 323 with a central aperture 324. The cutter head is fastened to the outer end of a shaft (not shown) journalled in the bearing 303 by a threaded stud. An end rectangular face plate 325 fits into the recess and is attached to the face 320 by a plurality of studs 326 threaded into apertures 327. FIG. 11 shows the inner face of the base member 320 in which there is a recess 328 for receiving an end portion of the power driven shaft. A collar is secured to the shaft and a plurality of threaded studs passing through the collar are threaded into apertures 329 thereby providing a secure mounting of the chipper head 302 on the shaft.

There are four equally spaced openings 330 through the base member for discharge of the chips removed by cutters detachably secured to the base member 320. Each opening 330 extends into the annular rim 322, as is evident from FIG. 11, and is defined by a wall 331 (generally U-shaped) on the truncated conical portion 321.

Each cutter head 302 has four main cutter blades 335 there being one for each of the openings 330. Each cutter blade 335 projects into a recess 336 in the head truncated conical portion 321 and each blade at its lower end projects into a slot 337 provided by the wall of the recess 336 on one side and an inner face portion of the annular rim 322. Each blade 335 is detachably secured to the base member 320 by a threaded stud 340.

Associated with each main cutter blade 336 is a secondary shaving type cutter 345. The cutter 345 fits into a recess 346 in the end face of the truncated conical portion 321 and each cutter is detachably secured to the base member 320 by a threaded stud 347.

Figure 12:
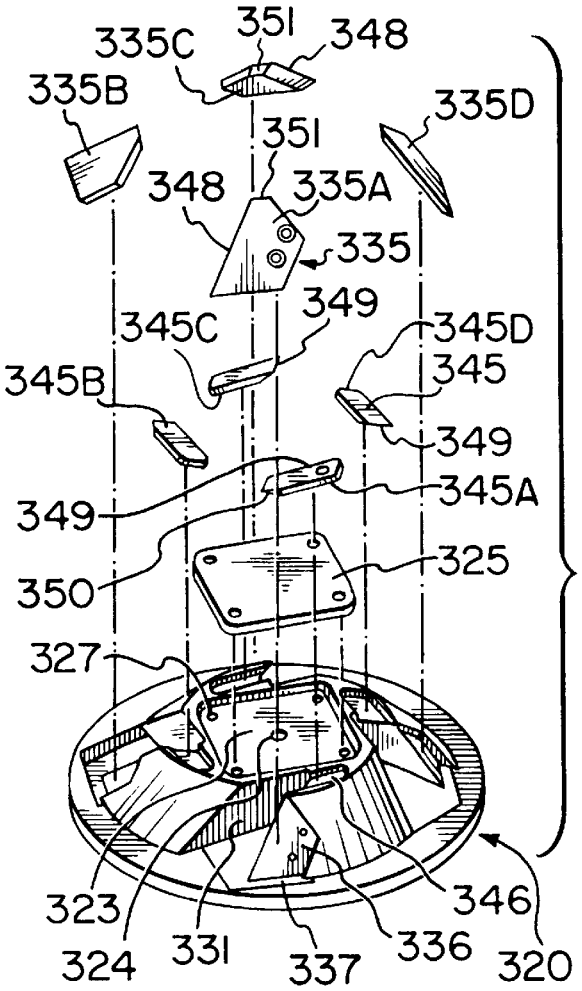
FIG. 12 is an exploded oblique view of the cutter head of FIG. 10 with the base plate and cutters removed.
Figure 13:
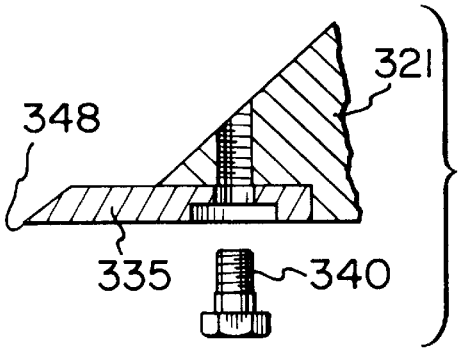
FIG. 13 is a sectional view taken along a portion of line 13—13 of FIG. 10.

The cutters 335 and 345 have respective straight line cutting edges 348 and 349 which facilitates sharpening and re-sharpening of the blades. The cutting blades are so positioned that the cutting edges 348 and 349 are contiguous even though they are in different planes and angularly disposed relative to one another. The two blades abut one another, blade 345 having an edge angular planar face 350 which abuts against an angular edge planar face 351 on the cutting blade 335. In FIG. 12 the four blades 345 at their four different positions are designated 345A, 345B, 345C and 345D. The main cutting blades 335 at these same respective positions are designated 335A, 335B, 335C and 335D. FIG. 12 being an oblique view shows the blades, because of their different positions, from different angles.

Figure 14:
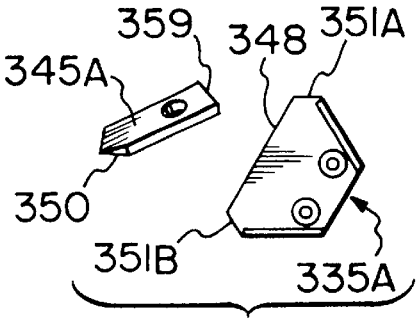
FIG. 14 is an oblique view of a pair of modified cutters.
Figure 15:
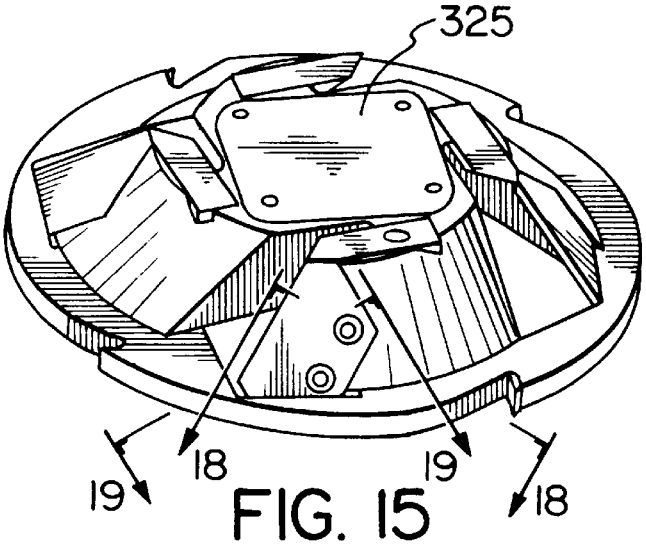
FIG. 15 is a view similar to FIG. 10 showing a modified cutter head with modified cutters.

Modifications to the foregoing described cutting head are illustrated in FIGS. 14 to 18 inclusive and referring to these the modifications only will be described. In FIG. 14 there is illustrated a modified main cutting blade 335A designed so as to be reversible permitting mounting the same on either one of the left and right, i.e. mirror image chipper cutting heads. The blade 335A has a cutting edge 348 and two apertures for mounting the latter being appropriately positioned to accommodate mounting reversibly using only one of the holes for the mounting. Each blade 335A has two angular disposed planar end faces 351A and 351B for abutting a planar edge face 350 on a shaving cutter blade 345A.

Figure 19:
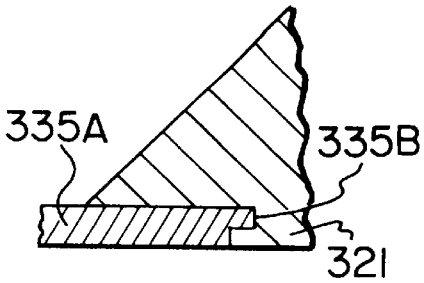
FIG. 19 is a sectional view along a portion of line 19—19 of FIG. 15—15.

The cutter blade 335A as seen from FIG. 19 has a tongue 335B that projects into a groove in the frusto conical portion 321 of the base member 320 to securely anchor the blade to the member 320.

Figure 18:
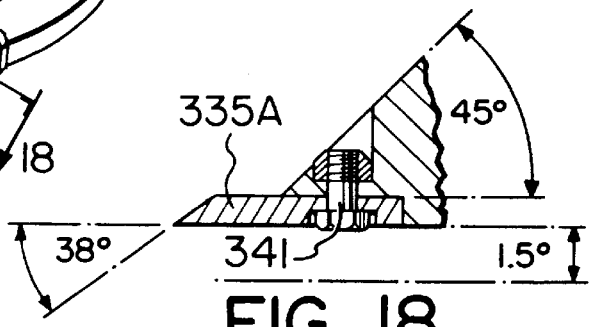
FIG. 18 is a sectional view along a portion of line 18—18 of FIG. 15.

A further minor change is illustrated in FIG. 18 wherein a bolt and nut unit 341 is used to securely and detachably fasten the cutting blade 335A to the base member.

Figure 16:
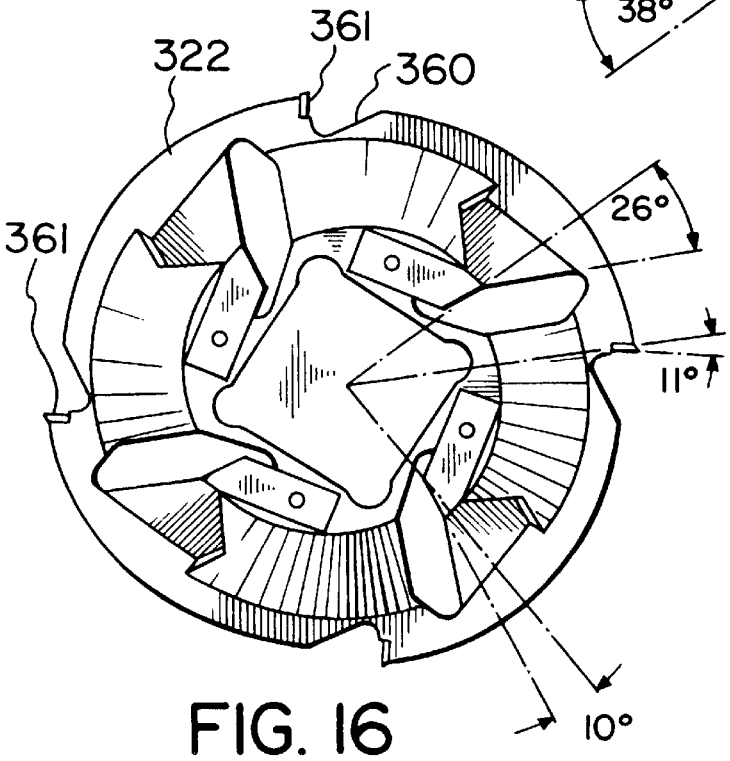
FIG. 16 is a top plan view of the cutter head shown in FIG. 15.

A further modification is illustrated in FIG. 16 wherein the outer peripheral edge of the member 322 is provided with four notches 360 and a removably mounted cutting blade or tooth 361.

Figure 17:
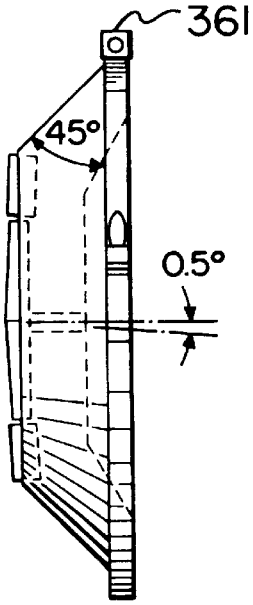
FIG. 17 is a side elevational view of FIG. 16.
Figure 20:
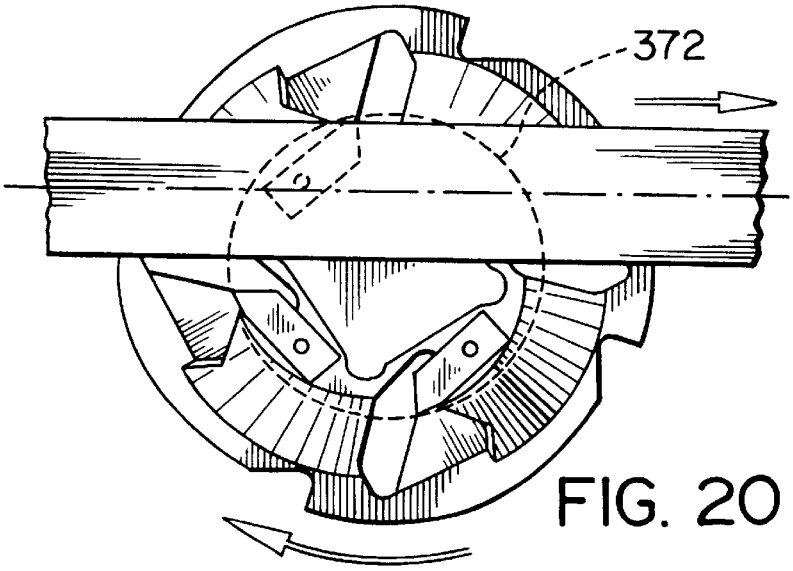
FIGS. 20 and 21 are respectively front and side elevational views illustrating a desired relative positioning of the canter cutter head and to the squared timber and feed path axis.

The face plate 325, as seen from FIG. 17, has an outer surface that projects further outwardly from the head at its center than at its outer peripheral edge. The face effectively may be described as a relatively flat conical face, the amount of taper being illustrated in FIG. 17 as 0.5°.

By way of example a cutting head having dimensions and angulations illustrated in FIGS. 16, 17 and 18 has been found to provide excellent results during operation of the prototype sawmill.

A further and minor modification is the square end 359 on the end of the cutter 345A and a corresponding shape for the recess in the cutter head base member to receive the same.

FIGS. 20 to 23 illustrate the preferred positioning of the cutting blades relative to the edge of the squared timber piece produced from the log L by the chipping canter heads. Referring to these drawings the squared timber piece is propelled endwise in the direction designated by arrow 370 (left to right in FIG. 1) and the cutter head rotates in the direction designated by arrow 371. The knife cutting edges 348 and 349 meet at a point which during rotation of the head trace out a circle illustrated in FIGS. 20 and 22 by the broken line 372. The location of this circular path of travel is so positioned as to be offset slightly outward from the upper face 373 of the squared timber piece and this relative positioning applies irrespective of the cross-sectional size of the squared piece of timber.

With the feed path being fixed in position the cutting heads 302 are mounted on the frame so as to be moved toward and away one another and also the positioning of the whole unit can be raised and lowered to maintain this relative positioning or in the case of a second chipper canter unit shown in FIG. 1 moved laterally in a horizontal position relative to the log. As previously discussed one canter unit of one pair can be pivotally mounted on frame 10 by shaft 410 and the other of such pair pivotally mounted by shaft 411 described with reference to FIG. 24. Position adjustment may be selectively done using adjusting mechanism 475.

The reaction from the cutting forces during chipping is in a direction tending to propel the squared timber piece along its path in the direction designated 370.

The edger section 400 is shown in greater detail in FIGS. 24 to 33.

The edger section 400 comprises a pair of edger units 400A and 400B each unit being the same except for the direction of rotation of the cutter head with a consequence of the shape of one cutting head being the mirror image of the other. Each of the units 400A and 400B are mounted on a base having the same structure as described previously with reference to FIGS. 8 and 9 illustrating the canter chipper units. Further description of the same accordingly will not be repeated herein for the sake of brevity and the same reference numerals for the base structures in FIG. 24 apply as in FIGS. 8 and 9.

Figure 25:
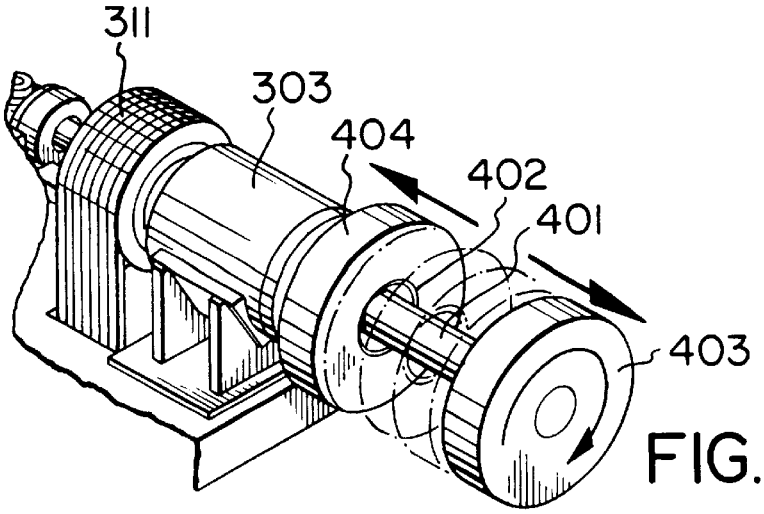
FIG. 25 is an oblique, partial diagrammatic, view of the head portion of one edger unit shown in FIG. 24.

Before referring to the details illustrated in FIG. 24 attention is directed to FIG. 25 which diagrammatically illustrates the cutter head portion of the edger unit 400B. The unit 400A is the same except rotation is in the opposite direction. Referring to FIG. 25 the edger unit 400B has two concentric, telescopically disposed, shafts designated 401 and 402 having respective cutting heads 403 and 404 attached thereto for rotation therewith. The shafts are journalled in a housing 303 secured to a mounting plate 304 and driven by a motor via belt means 311 or direct drive. The shafts rotate in unison by way of suitable coupling means, for example a key, that allows telescopic relative movement of the shafts. A shaft moving mechanism 425, described hereinafter, telescopically moves shaft 401 relative to shaft 402 selectively to vary the distance between the cutting heads 403 and 404.

The cutting heads 403 and 404 each have suitable cutting knives for rabbetting the squared timber piece. The upper edger unit 400A rabbets the two upper edges of the squared timber piece and the lower edger unit 400B rabbets the two lower edges of the squared timber piece. The rabbetted squared timber is shown in cross-section in FIG. 1 by the dotted line designated 450. By rabbetting the corners of the squared timber the actual squared timber before rabbetting can have exposed corners that are rounded, i.e. the original diameter of the log. This maximizes the recovery of lumber pieces from a log illustrated in FIG. 1 by sawing so as to have a piece of lumber in the centre which is of greater width than the outer two pieces of lumber. This will be more fully described hereinafter with reference to the outfeed conveyor section 600.

The edger unit 400A pivotally attaches to the stationary frame 10 by a pivot shaft 410 and the unit 400B pivotally attaches to the same frame by a mounting pivot shaft 411. A pair of adjusting mechanisms 475 for example turn buckles or hydraulic cylinder units are used to pivot the respective units for raising and lowering the edger cutting heads.

Referring further to FIG. 24 the outer shaft 402 is fixed in position by suitable radial and end thrust bearings in housing 303 and the shaft 401 projects beyond the drive and connects to a rotory coupling unit 415. This rotary coupling connects the shaft to a link of the cutter head spacing adjustment mechanism 425.

The mechanism 425 comprises a pair of link members 426 and 427 pivotally connected at one end thereof to a bar 428 which in turn by way of pivotal mounting 429 is connected to the rigid frame mechanism 306A. The pivot 429 is midway between the pivotal connection of the links 426 and 427 to the bar 428. The link 426 at the other end is pivotally connected as at 430 to a structure 431 rigidly secured to and projecting upwardly from the plate 304. The link 427 is pivotally connected by way of pivot pin 432 to the rotary coupling 415. A Temposonic* or the like hydraulic cylinder THR6 has the piston end thereof 433 connected by way of a pin (not shown) to lugs 434 on the plate 304. The cylinder portion by way of a pin 435 is connected to the rigid frame structure 306A by way of a bracket 436. The hydraulic cylinder THR6 is associated with the canter unit 400B and similarly a Temposonic type hydraulic cylinder THR5 is associated with the unit 400A. The hydraulic cylinders by way of the mechanism 425 move the cutting heads 403 and 404 simultaneously and by equal amounts either in a direction toward one another or in a direction away from one another depending upon actuation of the Temposonic cylinder. The cutting heads accordingly move equally and by the same amount toward and away from a vertical plane passing through the feed path axis. Raising and lowering the heads relative to the square timber piece, is provided by adjusting mechanisms 475 that connect the rigid frame structure 306A on respective units 400A and 400B to the frame structure 10. This vertical movement of the cutting heads, relative to the timber piece, permits selectively varying the depth of cut to be made while the adjusting mechanism 425 increases or decreases the width of cut inwardly from the vertical flat faces of the timber piece.

*Trade-Mark

Figure 26:
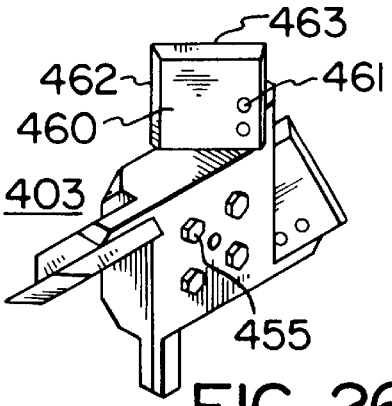
Figure 27:
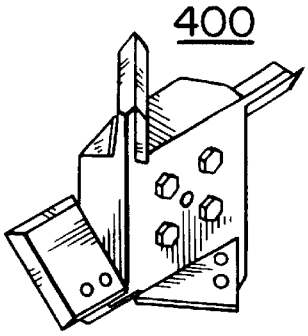
Figure 28:
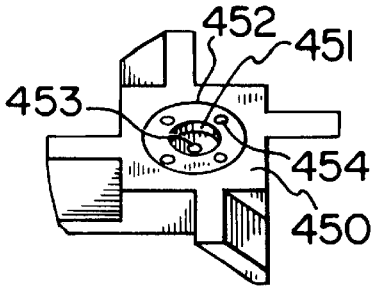
Figure 29:
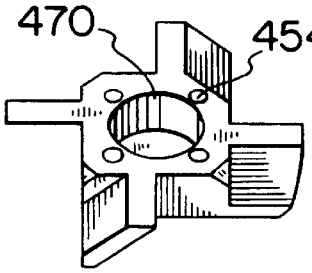

One embodiment of the outer cutter head 403 for the upper unit 400A is shown in FIG. 26 and the one for unit 400B is shown in FIG. 27. FIG. 28 is a rear view of the cutter head shown in FIG. 26. The two outer heads differ from one another only in that they rotate in opposite directions and therefore one is a mirror image of the other. In each instance the outer cutter head 403 comprises a rigid base piece or hub 450 having in the rear face thereof a first recess 451 for receiving an end portion of the shaft 401 and a second larger diameter shallower recess 452. There is a central aperture 453 surrounded by four stud receiving apertures 454. A collar (not shown) is rigidly secured to the shaft 401 and four studs 455 thread into the collar securely mounting the cutting head on the shaft.

The cutting head has four cutting blades 460 secured to the base member 450 by stud means 461. Each cutting blade has two straight line cutting edges designated 462 and 463 disposed at right angles to one another. The cutting edge 462 cuts the timber piece leaving a vertical face in the rabbet while the cutting edge 463 produces the horizonal face in the rabbet.

The inner cutting heads 402 are the same as the outer cutting heads except for the central portion which has a through central aperture portion 470 for sliding onto the end portion of shaft 402 and in that the inner and outer cutting heads on the same unit are left and right. Again the base member with the through aperture 470 has four spaced apart through holes 454 through which studs pass and are threaded into a collar (not shown) securely fixed to the shaft 402.

In FIGS. 30 to 33 there is illustrated a second embodiment of cutting heads for the rabbetting units 400A and 400B.

Figure 30:
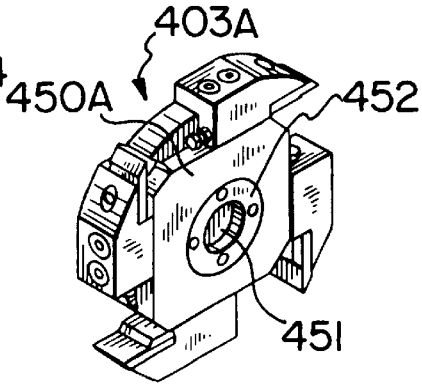

Referring to FIG. 30 illustrated from the rear face is a cutter head 403A for the upper rabbet unit 400A. The rear face of the hub 450A has respective concentric recesses 451 and 452 and stud receiving through holes 454 described with reference to FIG. 28. These provide means for mounting the cutter head on the shaft 401. As seen from the exploded view in FIG. 33 the hub has four equicircumferentially spaced peripheral flat faces 480 with threaded bores 481 and 482 for receiving respective ones of a pair of threaded studs 483. A cutting blade 484 with a slotted hole 485 is secured to a mounting block 486 by way of a threaded stud 487 and a plate like nut 488. The block 486 is recessed as at 489 to receive the cutting blade 484 and plate nut 488 and clampingly press the same captive between the block 486 and flat 481 on the hub. A knife adjusting screw 490 threads into a threaded aperture 491 in the block and it is aligned to engage the edge 492 of the blade remote from its cutting edge 493. The four blocks 486 abut against respective ones of four stops 495 on the hub. The blades are thus accurately positioned and are adjustable for precision repositioning after each sharpening.

Figure 31:
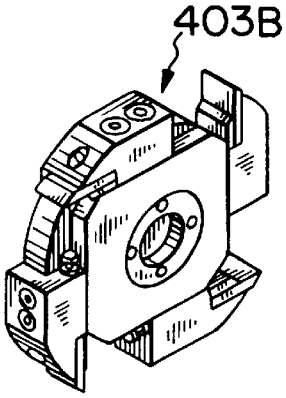

FIG. 31 is the same as FIG. 30 but illustrates a cutter head 403B for the lower rabbet unit 400B shown in FIG. 24.

Figure 32:
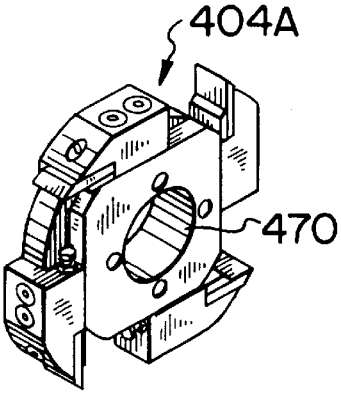
Figure 33:
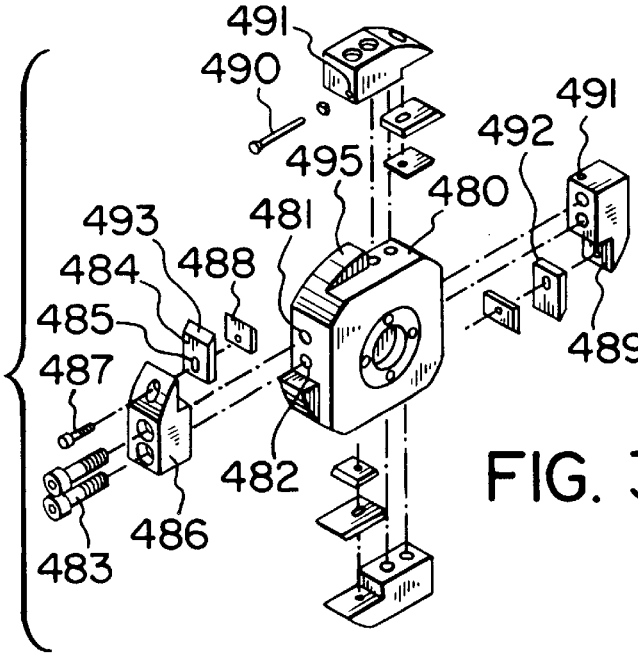

FIG. 32 shows the front face of an inner cutter head 404A for the upper rabbet unit 400A. The construction is the same as illustrated in FIG. 33 but the cutter blades are oriented in an opposite direction. The inner cutter head for the lower unit 400B is not shown but would have the same cutter orientation as that shown in FIG. 30 with the hub modified to have a through hold 470 for mounting onto a collar secured to the shaft 402.

The sawing section 500 is illustrated in FIGS. 35 and 36. There is an upper saw unit 500A and a lower saw unit 500B and these are mounted on a common rigid frame 501A. The frame 501A pivotally attaches to the frame structure 10 for pivotal movement about a vertical axis designated 502A for movement in an arcuate path designated 503. Pivotal movement of the frame structure 501A is controlled by hydraulic cylinders HR10 and HR11. It should be mentioned here that should there be a malfunction at any place along the processing path the hydraulic cylinders are immediately actuated moving the saw units 500A and 500B away from the squared timber piece thereby preventing damage to the circular saw blades.

Each saw unit 500A and 500B is mounted on a base structure which is the same as or identical to that described with reference to FIGS. 8 and 9 and accordingly further description of the same is not repeated for purposes of brevity. The same reference numerals are used in FIGS. 35 and 36 for the base structure as in FIGS. 8 and 9 and also as in FIG. 24 where the edgers also use the same base mounting structure.

The saw units 500A and 500B have respective circular saw blades 501 and 502 driven by respective motors 505 and 510. The rigid base structures 306A are secured to the frame structure 501A and the movable plates 304 permit raising and lowering the saw blades. Raising and lowering of the saw blades 501 and 502 is effected by actuation of respective Temposonic* hydraulic cylinders THR7 and THR8. These units have a piston end 515 thereof connected to lugs on the plate 304 and the cylinder portion is anchored as at 516 to the frame structure 501A.

*Trade-Mark

Positioning of the saw blades is relatively precise with each Temposonic* cylinder unit having an accuracy of ±1/1000 of an inch. With the squared timber rabbetted a horizontal cut is made by the saw blades 501 and 502 respectively above and below the horizontal face of the rabbet. Each saw blade accordingly cuts through the narrower dimensioned outer pieces of lumber designated 701 and 702 separating the same from the center piece 703 which is of greater width. This of course applies only when the corners of the timber piece has been rabbeted. In some instances rabbetting will not be done and this will depend upon the selected cut program based on the logs geometry. The saw blades are of appropriate size for example 20 inches in diameter and saw dust wastage may be minimized by using a thin kerf blade.

*Trade-Mark

Figure 38:
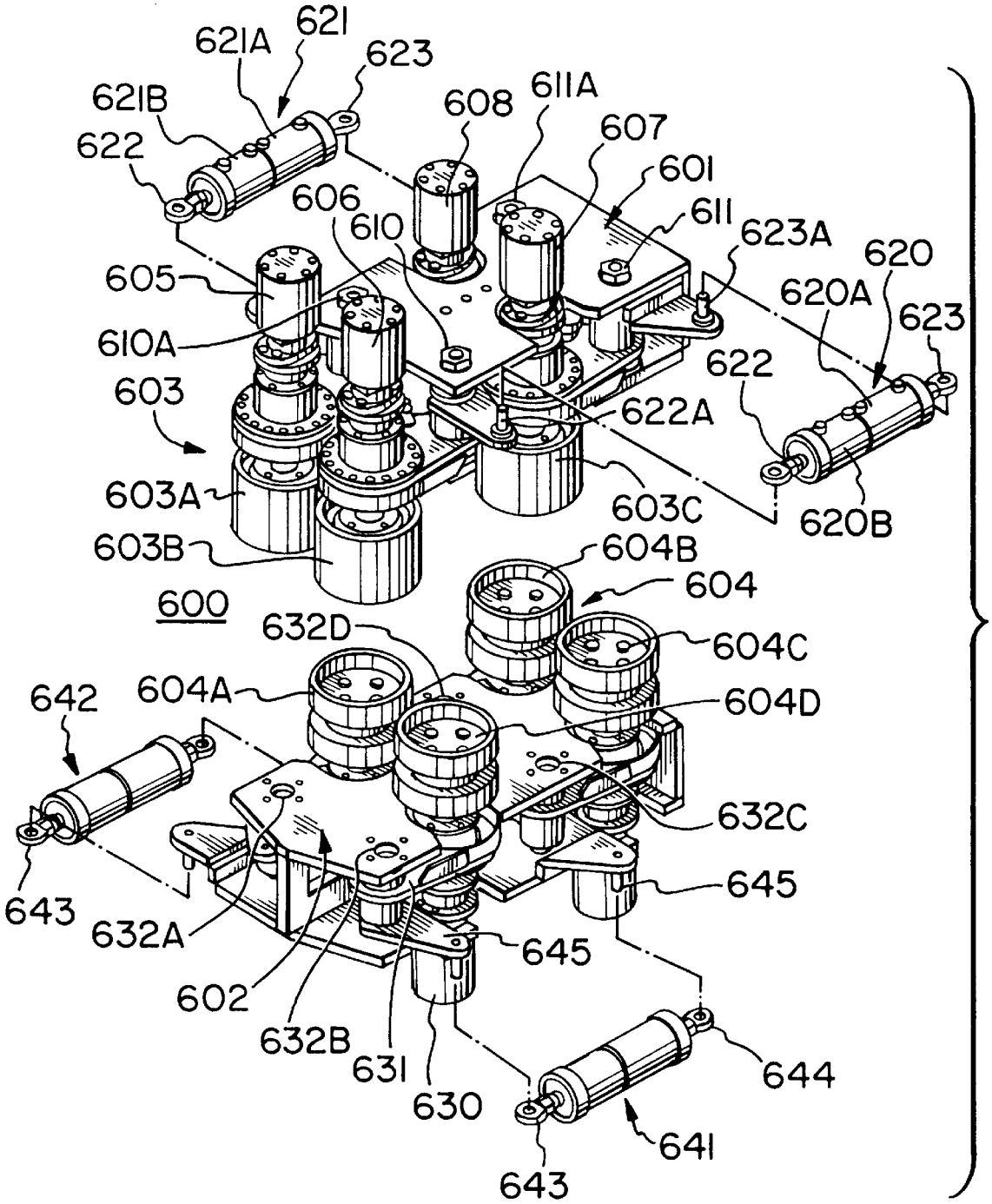
FIG. 38 is an oblique exploded view of the lumber outfeed conveyor.
Figure 39:
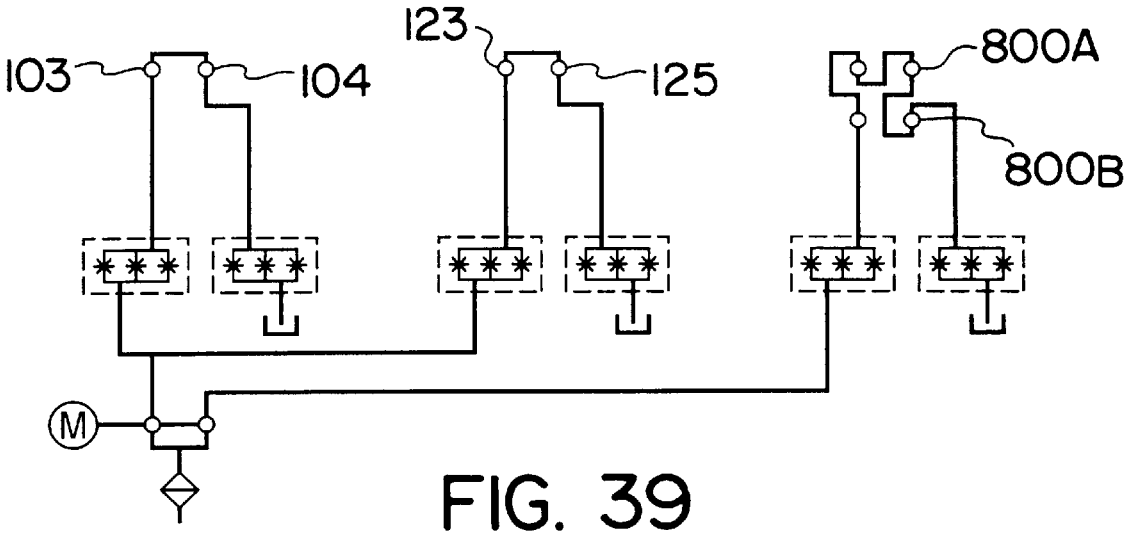
FIGS. 39 and 40 are schematics for the hydraulic control system for the sawmill diagrammatically and schematically illustrated in FIGS. 1 and 2.
Figure 40:
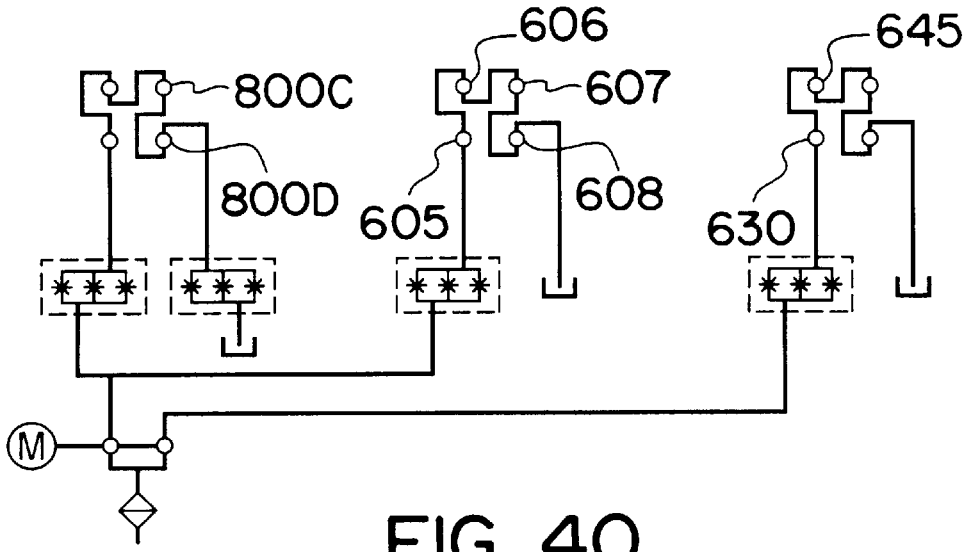

The outfeed conveyor 600 is shown in exploded oblique view in FIG. 38. Referring now to FIG. 38 the conveyor has a first frame 601 and a second frame 602 that provide mountings for respectively a first group of power driven rollers 603 and a second group of power driven rollers 604. There are four rollers in group 603 driven by respective motors 605, 606, 607 and 608, three of the four rollers being designated 603A, 603B and 603C with the fourth one not being in view.

The pair of rollers 603B and 603C are mounted on arms pivotally attached to the frame 601 by respective pivot pins 610 and 611 and similarly roller 603A and the one not in view are mounted on arms pivotally attached to the frame 601 by respective pivot pins 610A and 611A. The arms are controllably pivoted by pneumatic cylinder units 620 and 621. Each unit has two piston rods 622 and 623 in a common cylinder divided to provide separate pneumatic power units 620A, 620B and 621A, 621B.

The cylinders 620 and 621 can move power driven rolls 603A and 603B, 603C and the one not shown are moved toward and away from one another in the respective pairs. The piston rod 622 of unit 620B connects via pin 622A to a lug secured to the arm on which roller 603B is mounted and the piston rod 623 via pin 623A is anchored to the frame 601.

The group of power driven feed rolls 604 comprises four tandem spaced apart wheel like units 604A, 604B, 604C and 604D.

These tandem wheel units are driven by respective ones of four different hydraulic motors 630 via either direct drive or belts and if desired electric motors may be used instead of hydraulic. The tandem wheel units are mounted on respective ones of four arms 631 pivotally attached to the frame 602 as at 632A, 632B, 632C and 632D. The arms 631 on which the respective tandem wheel units 604A and 604B are mounted are connected to piston rod 643 of respective pneumatic cylinder units 641 and 642. Piston rods 644 of the respective units 641 and 642 are anchored to the frame 602 via respective ones of a pair of pins 645. The units 641 and 642 have two pistons in a common cylinder separated into two independent chambers. The wheel units 604A and 604B and similarly wheel units 604C and 604D are controllably moved by pneumatic cylinder units toward and away from one another.

As previously mentioned FIG. 38 is an exploded view and as seen from FIG. 1 in the assembled state rollers 603A and 603B are upstream of respective power driven rolls 604A and 604B. The power driven roll 603C is located between tandem wheel units 604B and 604C while the other roll not shown and driven by hydraulic motor 608 is located between tandem wheel units 604A and 604D.

The frames 601 and 602 are rigidly secured to the frame 10 and frame 601 and 602 may be securely joined one to the other if desired.

As previously mentioned there are three pieces of lumber produced in the illustrative example comprising outer lumber pieces 701 and 702 which are narrower in width than the center lumber piece 703. The center lumber piece 703 is gripped between power driven rolls 603A and 603B and between the pair of rolls 603C and the one driven by motor 608. The spacing of the wheels on the tandem wheel units 604A and 604B, 604C and 604D is such that the lumber piece 703 passes between the pairs of wheels. Each of the lumber pieces 701 and 702 are gripped between the pairs of tandem wheels 604A and 604B and between each of the pair of tandem wheels 604C and 604D.

From the foregoing it is readily apparent that each produced lumber piece is securely gripped between two pairs of power driven rolls for controllable outfeed and guidance of each lumber piece.

The timber piece is guided and propelled by a series of power driven rolls that are relatively small in diameter compared with the infeed rolls. The guide small power driven feed and guide rolls comprise a first pair 800A located between the two canter sections 300A and 300B, a second and a third pair designated respectively 800B and 800C located between the second canter chipper section 300B and the edgers 400 and two further pairs designated 800D and 800E located between the edger 400 and the saw section 500. The rolls in each pair are driven by respective hydraulic motors 801 and 802 shown in FIG. 1 with respect to feed roll unit 800A. For sake of clarity the hydraulic motors are not shown with respect to the pairs of feed roll units 800B, 800C, 800D and 800E. As will be seen from FIG. 1 the power driven roll unit 800D and 800E tractively engage the vertical side faces of the square timber piece while the pairs of rolls 800C and 800E engage respectively the upper and lower faces.

As previously mentioned the reactionary forces from the chipper canters is such on the log as to tend to propel the log endwise in a path of travel from left to right as viewed in FIG. 1 as is also the case with the edging units 400A and 400B. The saw at the other hand is driven to rotate in a direction against the direction of travel of the timber piece.

Figure 41:
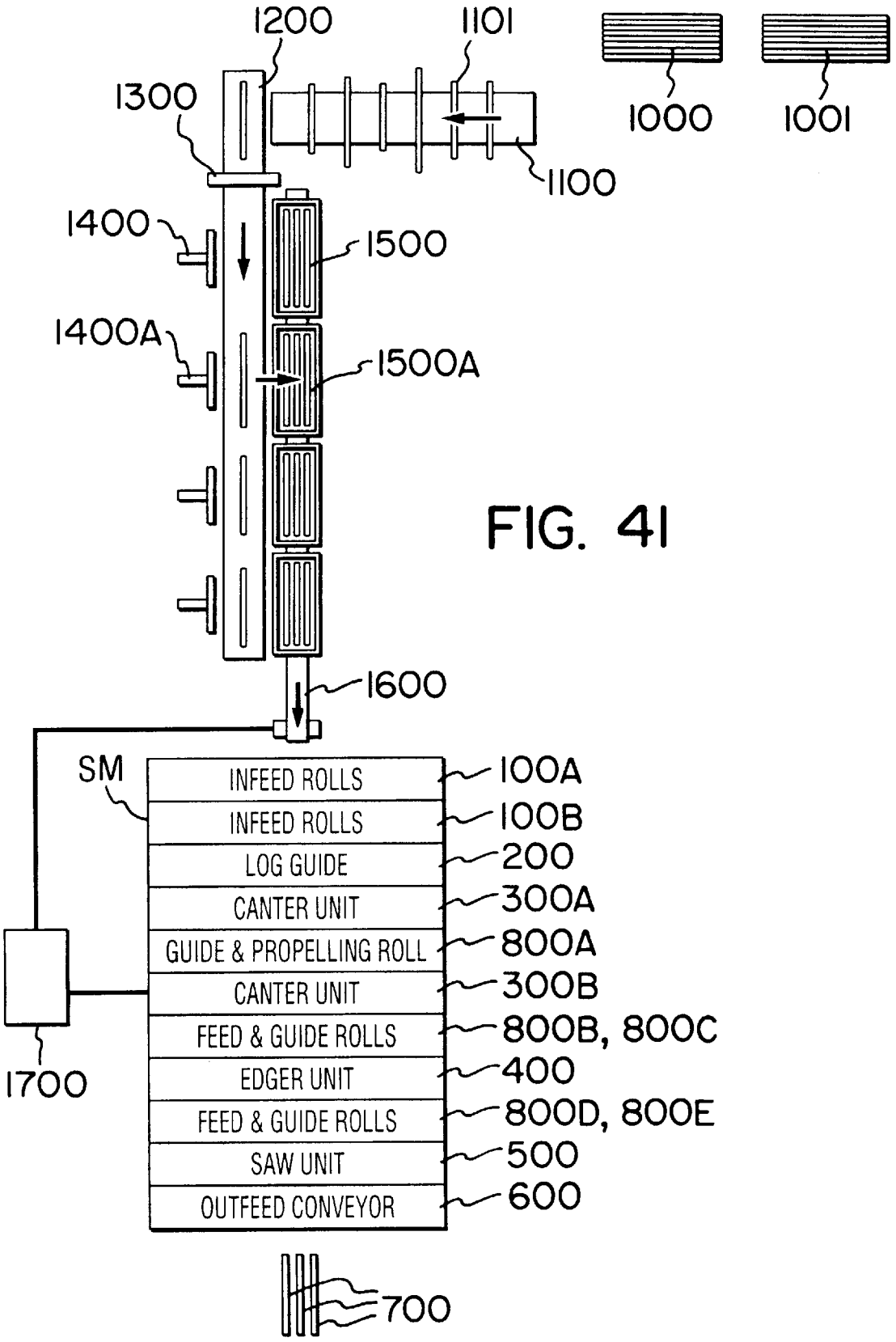
FIG. 41 is a schematic of a mill system using to advantage the foregoing sawmill and is an example only of one of many different arrangements.

The foregoing described sawmill is most effective when the logs being processed are previously sorted so that they are similar in geometry. In FIG. 41 there is a diagrammatic illustration of a system environment in which the foregoing described sawmill is utilized. Referring now to FIG. 41 there is illustrated two piles of logs designated 1000 and 1001 which are of an 8 or 9 foot length as received from field logging operations. Logs from this are loaded onto a conveyor 1100 which spaces one log 1101 from the next and discharges a log one at a time onto an endless belt conveyor 1200. Arrows indicate the direction of travel. The logs one by one pass under a scanner 1300 and downstream from the scanner one of four (or five or more) different kickers 1400 transfer the logs according to log geometry or size into respective ones of four different holding bins 1500. The logs for example in bin 1500A are essentially of the same diameter for example 5 inches. The logs in another bin may be 4" in diameter and 6" in another bin.

The foregoing sawmill of FIG. 1 designated SM in FIG. 41 has the infeed rolls thereof aligned with a belt type conveyor 1600 that for example is feeding logs one at a time from the bin 1500A to the sawmill. The logs are essentially the same geometry that are being processed as they are propelled through the sawmill and as indicated there is at the infeed end infeed rolls 100A and 100B along with the previously described log guide 200 followed by in succession, canter unit 300A, guide and propelling roll unit 800A, canter unit 300B, propelling and guide roll units 800B and 800C, edger unit 400, feed and guide roll units 800D and 800E, saw unit 500 and the outfeed conveyor 600 from which there is discharged pieces of lumber 700.

Processing is controlled by a computer processor unit 1700. The programmed processor unit controls the sawmill units for maximized lumber value or volume recovery relative to the geometry of logs being processed.

The propelling speed of the logs can be selectively varied within a range of about 300 to 500 feed per minute and the speed of the chipper heads may be controllably varied so as to run at different fixed speeds. This adjustable speed is important for the purpose of minimizing variation of chips and providing chips of different sizes. High quality and different chip size can be produced consistently providing a valued added product from the sawmill system. The length of chip varies directly with feed speed a ¾" chip length being produced at a log feed speed of 300 ft./min., a 1" chip length at 400 ft./min. and a 1⅛th" chip length at a feed speed of 450 ft./min.

As an alternative to the system illustrated in FIG. 41 and in place of presorting each log can be scanned as it is fed to the sawmill and the information therefrom fed to the processor 1700 which determines from the log geometry the best cutting pattern. Signals from the processor are used then to control movement of the different processing units to accomplish the desired result. Rabbetting may or may not occur depending upon the predetermined cutting pattern. The log instead of being cut into a square may be rectangular in cross-section. The log geometry may dictate a cut pattern of for example 3-2 ×6's, or a single 2×2 or one 2×6 and two 2×4's or any other pattern for maximum value and/or volume of recovery.

The edger rabbetting is done selectively i.e. only when required as dictated by the cut pattern which in turn is dependent upon information received from log scanning. The log scanning provides information to the processor as to log diameter and geometry.

The pattern of cut may for example be 2-2"×4"'s and 1-2"×6" from a log or 2-1"×4"'s and 1-2"×6" and this would require rabbetting the squared timber piece. Rabbetting is not required when the lumber pieces are to be the same size which by way of example might be 1-2"×2" or 2-2"×4" or 3-2"×4" or 3-2"×6" pieces of lumber from one log.

The components are precision adjustably positioned and this is done through hydraulic and/or pneumatic units.

We claim:

1. A compact sawmill comprising:

(a) a frame structure including a primary frame portion and a secondary frame portion;

(b) a plurality of power driven feed and guide rolls movably mounted on said frame for propelling and guiding a log endwise along a predetermined feed path, said feed rolls including a first pair and a second pair of power driven infeed rolls in which said pairs are offset 90° from one another around said feed path, said infeed rolls being mounted on said secondary frame portion, and means mounting said secondary frame portion on said primary frame portion whereby said pairs of infeed rolls are selectively movable as a unit out of alignment with said feed path providing access to processing components immediately downstream therefrom for servicing the same;

(c) a canting section comprising power driven cutters movably mounted on said primary frame portion to reduce said log to a square timber piece as the log is propelled endwise along said selected feed path, said canting section further including a first and second pair of chipper units offset from one another 90° about said feed path;

(d) a selectively operable edger section comprising power driven cutters movably mounted on said primary frame portion and located downstream from said canting section selectively to rabbet the corners of the squared timber piece as such timber piece moves along said predetermined feed path, said edger section comprising a first and second pair of edger units in which one of said units has cutters on horizontally disposed shafts to rabbet the two upper corners and the other of said units has cutters on horizontally disposed shafts to rabbet the remaining two lower edges of said squared timber piece; and (e) a sawing section comprising power driven cutters travelling in horizontal planes and movably mounted on said primary frame portion for sub-dividing the squared timber into pieces of lumber.

2. A compact sawmill as defined in claim 1 wherein at least one of said pieces of lumber is narrower in width than another one of said produced pieces of lumber.

3. A compact sawmill as defined in claim 2 including an off-feed mechanism comprising a plurality of power driven rollers movably mounted on said primary frame portion for gripping therebetween opposed marginal edges of said pieces of lumber.

4. A compact sawmill as defined in claim 3 wherein said off-feed mechanism comprises at least a first and a second pair of power driven rollers and wherein said first pair have cylindrical rollers thereon for gripping therebetween the wider piece of lumber, wherein said second pair have dual, spaced apart, wheels thereon for gripping therebetween said narrower pieces of lumber and wherein said spacing of said wheels is greater than the thickness of said wider piece of lumber.

5. A compact sawmill as defined in claim 1 wherein each said chipping unit has a frusto conical chipper head with a primary cutting blade on the frusto conical portion and a shaving cutting blade on a flat end face portion of the cutting head.

6. A compact sawmill as defined in claim 5 wherein each of said cutting blades has a straight line cutting edge with such edges abutting one another and disposed at selected angles relative to one another.

7. A compact sawmill as defined in claim 1 wherein each said edger unit comprises an innermost and an outermost pair of power driven shafts disposed in telescopic relation, a first outer cutting head mounted on the innermost shaft and an inner cutting head mounted on said outermost shaft and means for moving said pair of cutting heads selectively toward and away from one another.

8. A compact sawmill as defined in claim 1 wherein said sawing section comprises a pair of power driven, horizontally disposed circular saws positioned in vertical spaced apart relation and means mounting said saws for movement on said primary frame portion in a direction toward and away from one another and in a direction toward and away from a timber piece being propelled along said predetermined feed path.

9. A compact saw mill as defined in claim 1 wherein said frame comprises a plurality of interconnected members and including an off-feed mechanism comprising power driven rollers movably mounted on said primary frame portion and tractively engaging opposed vertical marginal edges of said pieces of lumber and wherein said power driven feed and guide rolls are interspersed between selected ones of said canting, edger and sawing sections for propelling logs one after another endwise along said selected feed path.

10. A compact sawmill as defined in claim 1 including means pivotally mounting said secondary frame portion on said primary frame portion.

11. A compact sawmill as defined in claim 10 including power means for pivotally moving said second frame portion.

12. A compact sawmill as defined in claim 11 wherein said secondary frame is pivotally movable to a raised position and including means releasably to retain said secondary frame in said raised position.

13. A compact sawmill as defined in claim 1 wherein said sawing section comprises a pair of sawing units and wherein each said chipper, edger and sawing unit has a power driven head mounted on a base plate, means slidably mounting said base plate on said primary frame portion and means to controllably selectively move said base plates for the respective units to adjustably move in directions toward and away from said predetermined feed path.

14. A compact sawmill as defined in claim 5 including means selectively to vary at least one of the feed speed of a log being processed and the rotational speed of the chipper heads to produce chips of selected size.

15. A compact sawmill as defined in claim 8 wherein said saws are aligned with an edge face of the respective rabbets in the squared timber piece.

16. A compact sawmill as defined in claim 1 including a programmable processor means operatively controlling positioning of the edger canting and sawing section power driven cutters to maximize volume recovery relative to the geometry of the log to be processed.

* * * * *